US009471002B2

(12) United States Patent
Okada et al.

(10) Patent No.: US 9,471,002 B2
(45) Date of Patent: Oct. 18, 2016

(54) POWER SUPPLY UNIT FOR APPLYING A VOLTAGE TO A DEVELOPER CARRIER, IMAGE FORMING APPARATUS, AND METHOD FOR APPLYING VOLTAGE

(71) Applicant: KYOCERA Document Solutions Inc., Osaka (JP)

(72) Inventors: Masanori Okada, Osaka (JP); Tatsuya Nakagawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/952,416

(22) Filed: Nov. 25, 2015

(65) Prior Publication Data

US 2016/0154367 A1 Jun. 2, 2016

(30) Foreign Application Priority Data

Nov. 28, 2014 (JP) ..... 2014-241146
Nov. 28, 2014 (JP) ..... 2014-241287

(51) Int. Cl.
*G03G 15/06* (2006.01)
*G03G 15/08* (2006.01)
*G03G 15/00* (2006.01)

(52) U.S. Cl.
CPC ..... *G03G 15/065* (2013.01); *G03G 15/08* (2013.01); *G03G 15/80* (2013.01)

(58) Field of Classification Search
CPC ..... G03G 15/065
USPC ..... 399/55
See application file for complete search history.

(56) References Cited

U.S. PATENT DOCUMENTS

2013/0322899 A1 12/2013 Okada ..... 399/44

FOREIGN PATENT DOCUMENTS

JP 06222676 A * 8/1994
JP 07271139 A * 10/1995
JP 2013-250302 A 12/2013

* cited by examiner

*Primary Examiner* — Walter L Lindsay, Jr.
*Assistant Examiner* — Milton Gonzalez
(74) *Attorney, Agent, or Firm* — Stein IP, LLC

(57) ABSTRACT

Provided is a power supply unit that quickly stabilizes a voltage to be applied to a developer carrier. The power supply unit, which applies a voltage to a developer carrier, includes a DC power supply portion, an AC power supply portion, a current detecting portion for detecting current input to the developer carrier, a voltage correcting portion for decreasing at least one of voltage levels of the DC voltage and the AC voltage more as the current detected by the current detecting portion becomes larger, and a development control portion for starting application of one of the DC voltage and the AC voltage as a first voltage at a first time point, and starting application of the other of the DC voltage and the AC voltage as a second voltage at a second time point that is a predetermined time after the first time point.

6 Claims, 9 Drawing Sheets

FIG.4A
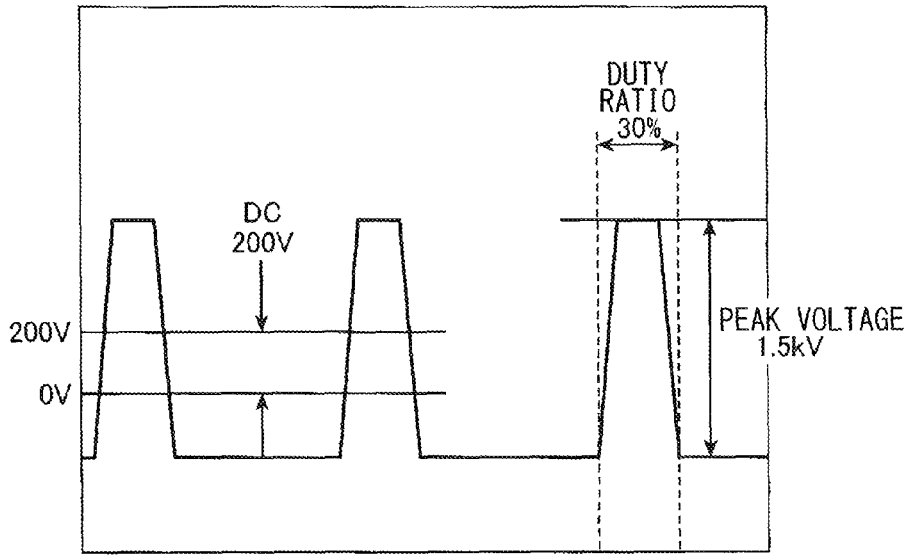
FIG.4B
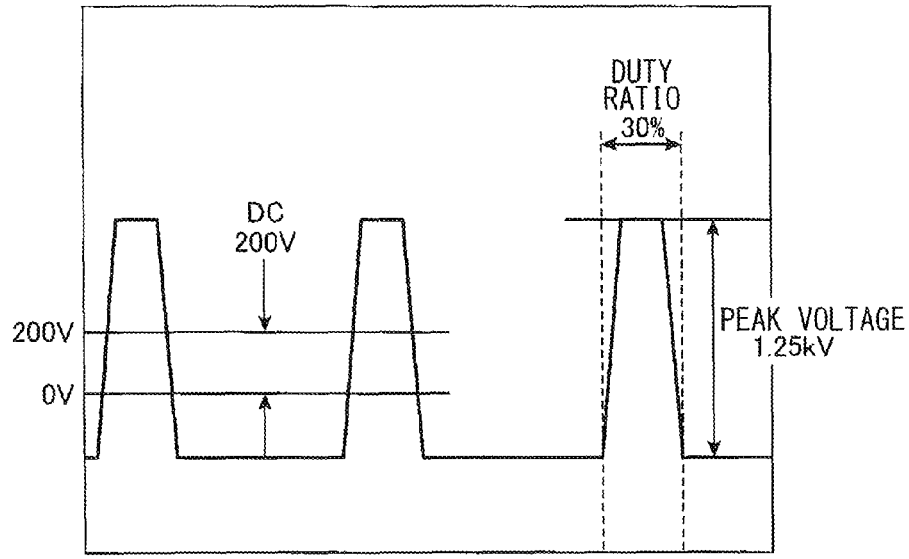
FIG.5
| VARIATION | CORRECTION DATA |
|---|---|
| +10μA | DC-20V |
| +20μA | DC-25V |
| -10μA | DC+20V |
| -20μA | DC+25V |

POWER SUPPLY UNIT FOR APPLYING A VOLTAGE TO A DEVELOPER CARRIER, IMAGE FORMING APPARATUS, AND METHOD FOR APPLYING VOLTAGE

INCORPORATION BY REFERENCE

This application is based upon and claims the benefit of priority from the corresponding Japanese Patent Applications No. 2014-241146 filed Nov. 28, 2014 and No. 2014-241287 filed Nov. 28, 2014, the entire contents of which are hereby incorporated by reference.

BACKGROUND

The present disclosure relates to a power supply unit and an image forming apparatus, and particularly to a technique for applying a voltage to a developer carrier.

Conventionally, there is known a technique of applying a developing roller (developer carrier) with a developing bias voltage in which a DC voltage and an AC voltage are added, so as to develop a latent image while maintaining intensity of electric field generated between a photosensitive member (image carrier) and the developing roller to be constant, and hence deterioration of image quality is suppressed. The DC voltage and the AC voltage are appropriately determined in accordance with, for example, magnetic intensity of the developer, a photosensitive material (e.g., amorphous silicon) forming the surface of the photosensitive member, and the like.

Even if an optimized developing bias voltage is applied, when a distance between the photosensitive member and the developing roller varies due to a factor such as eccentricity of the developing photosensitive member, intensity of the electric field generated between the photosensitive member and the developing roller is varied. As a result, an amount of the developer to be supplied to the photosensitive member may be excessive or insufficient.

Accordingly, conventionally, it is common to sense a capacitance between the photosensitive member and the developing roller as an indicator of the distance between the photosensitive member and the developing roller on the basis of current input to the developing roller, and to perform correction in which the developing bias voltage is decreased more as an increase of the detected current is larger while the developing bias voltage is increased more as a decrease of the detected current is larger.

However, the DC voltage and the AC voltage that are applied as the developing bias voltage are generated by transforming the AC voltage supplied from an AC power source such as a commercial power source or by converting the AC voltage into a DC voltage, and hence they are gradually stabilized at predetermined levels after a certain period of time has elapsed from start of application.

Accordingly, in the structure where the developing bias voltage is corrected on the basis of a variation of the current input to the developing roller as the conventional technique described above, when application of the DC voltage and application of the AC voltage, which are applied as the developing bias voltage, are simultaneously started, the developing bias voltage may be largely decreased for correction because an increase of the current is large during a transition period from start of the application until the developing bias voltage is stabilized at a predetermined level.

In this case, the developing bias voltage is once largely decreased in the transition period, and hence the period necessary until the developing bias voltage is stabilized may be longer than the sum of a period necessary until the DC voltage is stabilized and a period necessary until the AC voltage is stabilized when the DC voltage and the AC voltage are individually applied one by one. As a result, a period necessary until a developing operation is started may be increased.

SUMMARY

A power supply unit according to an aspect of the present disclosure, which applies a voltage to a developer carrier that carries developer, includes a DC power supply portion that applies a DC voltage that is gradually stabilized at a predetermined level to the developer carrier, an AC power supply portion that applies an AC voltage that is gradually stabilized at a predetermined level to the developer carrier, a current detecting portion that detects current input to the developer carrier, a voltage correcting portion that decreases at least one of voltage levels of the DC voltage and the AC voltage more as the current detected by the current detecting portion becomes larger, and a development control portion that starts application of one of the DC voltage and the AC voltage as a first voltage at a first time point, and to start application of the other of the DC voltage and the AC voltage as a second voltage at a second time point that is a predetermined time after the first time point.

In addition, the development control portion controls the AC power supply portion to start the application of the AC voltage having a higher level than a predetermined AC target level at a first time point, to control the DC power supply portion to start the application of the DC voltage having a predetermined DC target level at a second time point after the first time point, and to change the AC voltage level applied by the AC power supply portion to the AC target level at a third time point that is a predetermined set time after the first time point.

An image forming apparatus according to another aspect of the present disclosure includes the power supply unit and an image forming portion, which includes an image carrier for carrying a latent image disposed at a position opposed to the developer carrier, and the developer carrier. When the power supply unit applies the first voltage and the second voltage to the developer carrier so that the developer is supplied to the latent image, the image forming apparatus transfers a developed image on the image carrier onto a paper sheet.

In addition, the image forming apparatus may include a power supply unit equipped with a development control portion that applies an AC voltage having a higher level than a predetermined AC target level at a first time point, to apply a DC voltage having a predetermined DC target level at a second time point, and to change an AC voltage level to the AC target level third time point, and an image forming portion, in which the image forming portion transfers a developed image on the image carrier onto a paper sheet when the power supply unit applies the DC voltage and the AC voltage to the developer carrier so that the developer is supplied to the latent image.

A method for applying a voltage according to another aspect of the present disclosure includes: starting application of one of the DC voltage and the AC voltage as a first voltage at a first time point, when a voltage is applied to the developer carrier; and starting application of the other of the DC voltage and the AC voltage as a second voltage at a second time point that is a predetermined time after the first time point.

In addition, the method for applying a voltage may include: controlling the AC power supply portion to start the application of the AC voltage having a higher level than a predetermined AC target level at a first time point, when a voltage is applied to the developer carrier; controlling the DC power supply portion to start the application of the DC voltage having a predetermined DC target level at a second time point after the first time point; and changing the AC voltage level applied by the AC power supply portion to the AC target level at a third time point that is a predetermined set time after the first time point.

BRIEF DESCRIPTION OF THE DRAWINGS

FIG. 4A is a schematic diagram illustrating an example of a waveform of a developing bias voltage.

FIG. 4B is a schematic diagram illustrating an example of a waveform of the developing bias voltage.

FIG. 5 is a schematic diagram illustrating an example of correction data stored in a variation storage portion.

DETAILED DESCRIPTION

Figure 1:
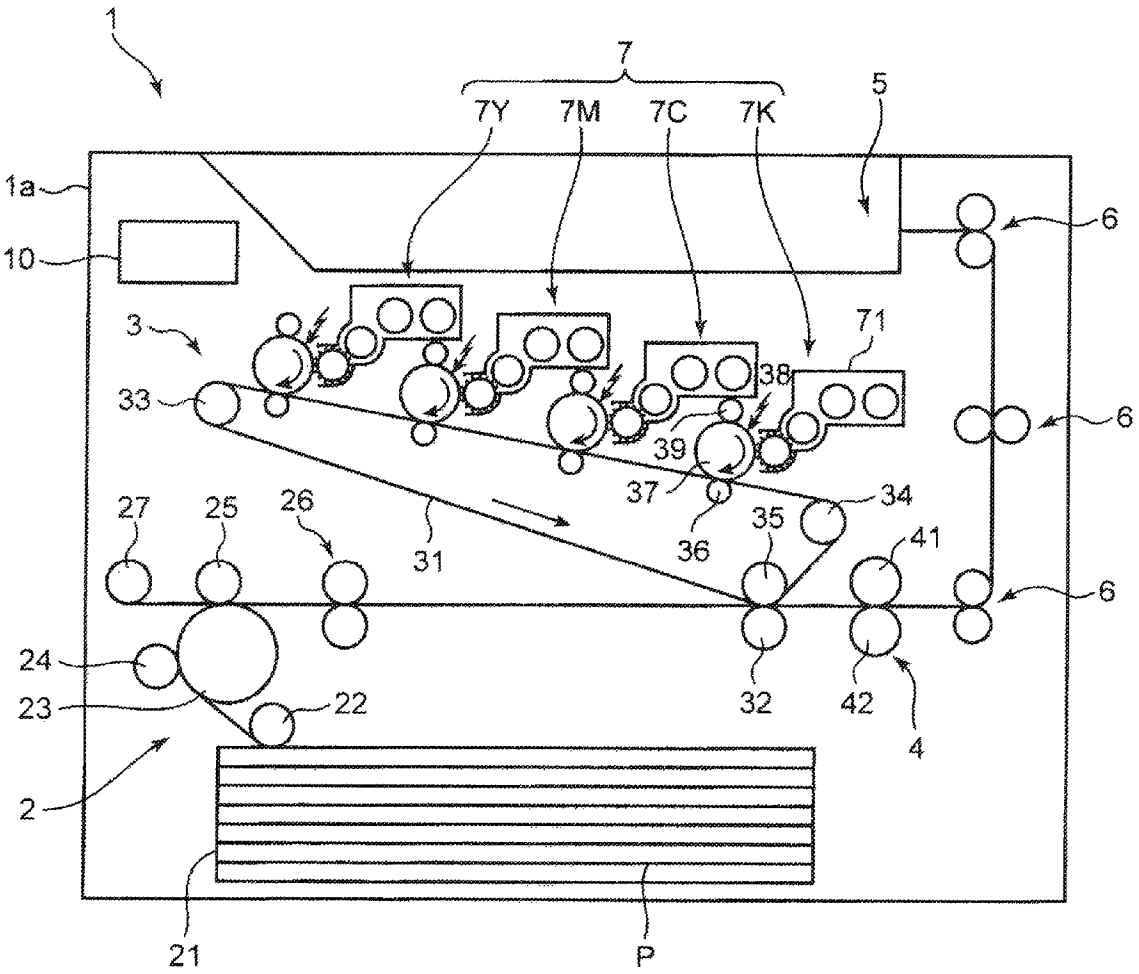
FIG. 1 is a schematic cross-sectional view illustrating a general structure of a printer of an image forming apparatus according to an embodiment the present disclosure.

Now, an image forming apparatus according to an embodiment of the present disclosure is described with reference to the drawings. A printer is exemplified as the image forming apparatus in this embodiment, but this is not a limitation. The image forming apparatus may be a copier, a facsimile apparatus, or a multifunction peripheral, for example. FIG. 1 is a schematic cross-sectional view illustrating a general structure of a printer 1 as the image forming apparatus according to an embodiment of the present disclosure.

AS illustrated in FIG. 1, the printer 1 includes a paper sheet feeder 2 for feeding a paper sheet P, an image forming portion 3, and a fixing portion 4 in an apparatus main body 1*a*. The image forming portion 3 conveys the paper sheet P fed from the paper sheet feeder 2 while a toner image based on image data received from an external computer or the like is transferred onto the paper sheet P. The fixing portion 4 performs a fixing process in which the toner image transferred onto the paper sheet P by the image forming portion 3 is fixed onto the paper sheet P. In addition, a sheet discharging portion 5 for discharging the paper sheet P after the fixing process by the fixing portion 4 is disposed on an upper surface of the apparatus main body 1*a*.

The paper sheet feeder 2 includes a sheet feed cassette 21, pickup rollers 22 and 27, sheet feeding rollers 23, 24, and 25, and registration rollers 26. The sheet feed cassette 21 stores the paper sheets P. The pickup roller 22 picks up the paper sheets P stored in the sheet feed cassette 21 one by one. The pickup roller 27 picks up the paper sheet P placed on a manual feed tray (not illustrated) attached to a left side of the apparatus main body 1*a* as illustrated in FIG. 1. The sheet feeding rollers 23, 24, and 25 send out the paper sheet P picked up by the pickup roller 22 or 27 to a paper sheet transport path. The registration roller 26 temporarily stops the paper sheet P sent out to the paper sheet transport path by the sheet feeding roller 23, 24, and 25, and then feeds the paper sheet P to the image forming portion 3 at a predetermined timing.

The image forming portion 3 includes an image forming unit 7, an intermediate transfer belt 31, and a secondary transfer roller 32. The image forming unit 7 performs primary transfer of the toner image based on the image data received from the external computer or the like onto a surface (contact surface) of the intermediate transfer belt 31. The secondary transfer roller 32 performs secondary transfer of the toner image on the intermediate transfer belt 31 onto the paper sheet P sent from the sheet feed cassette 21.

The image forming unit 7 includes a black unit 7K, a cyan unit 7C, a magenta unit 7M, and a yellow unit 7Y. Each of the units 7K, 7C, 7M and 7Y includes a photosensitive drum 37 (image carrier). Each photosensitive drum 37 rotates in an arrow direction (clockwise direction) illustrated in FIG. 1. A charger 39, an exposing device 38, a developing device 71, and the like are disposed around the each photosensitive drum 37.

The charger 39 charges a circumferential surface of the photosensitive drum 37. The exposing device 38 irradiates the circumferential surface of the charged photosensitive drum 37 with a laser beam based on the image data. In this way, the exposing device 38 forms a latent image based on the image data on the photosensitive drum 37.

The developing device 71 supplies toner to the circumferential surface of the photosensitive drum 37 on which the latent image is formed, so as to form the toner image on the circumferential surface of the photosensitive drum 37. The toner image formed on the circumferential surface of the photosensitive drum 37 is primarily transferred onto the intermediate transfer belt 31 as described later.

The intermediate transfer belt 31 is a rotating endless belt. The intermediate transfer belt 31 is wound around a plurality of rollers including a drive roller 33, a follower roller 34, a backup roller 35, and primary transfer rollers 36, so that the surface (contact surface) contacts with each of the circumferential surfaces of the photosensitive drums 37. In addition, the intermediate transfer belt 31 is driven to rotate endlessly by the plurality of rollers in the state of being pressed to the photosensitive drums 37 by the primary transfer rollers 36 disposed to be opposed to the photosensitive drum 37.

The drive roller 33 rotates the intermediate transfer belt 31 endlessly by a drive force from a drive source such as a stepping motor. The follower roller 34, the backup roller 35, and the primary transfer rollers 36 are rotated to follow the endless rotation of the intermediate transfer belt 31 with the drive roller 33.

The primary transfer roller 36 applies a primary transfer bias (having a polarity opposite to electrification polarity of the toner) to the intermediate transfer belt 31. In this way, the toner images formed on the photosensitive drums 37 are sequentially superimposed on the intermediate transfer belt 31 rotating in the arrow direction (counterclockwise direction) as illustrated in FIG. 1 by drive by the drive roller 33 between each of the photosensitive drum 37 and each of the primary transfer roller 36, and hence the transfer (primary transfer) is performed.

The secondary transfer roller 32 applies the paper sheet P with a secondary transfer bias having an opposite polarity to the toner image. In this way, the toner image that is primarily transferred onto the intermediate transfer belt 31 is transferred onto the paper sheet P between the secondary transfer roller 32 and the backup roller 35, so that the color transferred image is transferred onto the paper sheet P.

The fixing portion 4 performs the fixing process on the transferred image transferred onto the paper sheet P by the image forming portion 3. The fixing portion 4 includes a heating roller 41 and a pressure roller 42 having a circumferential surface pressed to a circumferential surface of the heating roller 41. The transferred image transferred onto the paper sheet P is fixed to the paper sheet P by the fixing process with heat when the paper sheet P passes through between the heating roller 41 and the pressure roller 42. The paper sheet P after the fixing process is discharged to the sheet discharging portion 5 by a convey roller 6. The convey roller 6 is disposed at an appropriate position between the fixing portion 4 and the sheet discharging portion 5.

In addition, a control unit 10 is disposed in the apparatus main body 1*a*. The control unit 10 is constituted of, for example, a microcomputer including a central processing unit (CPU), a read only memory (ROM) for storing a control program, a random access memory (RAM) for temporarily storing data when performing various processes, an input and output interface circuit, and a bus for connecting them. The control unit 10 controls individual portions in the apparatus by executing the control program stored in the ROM or the like by the CPU.

Figure 2:
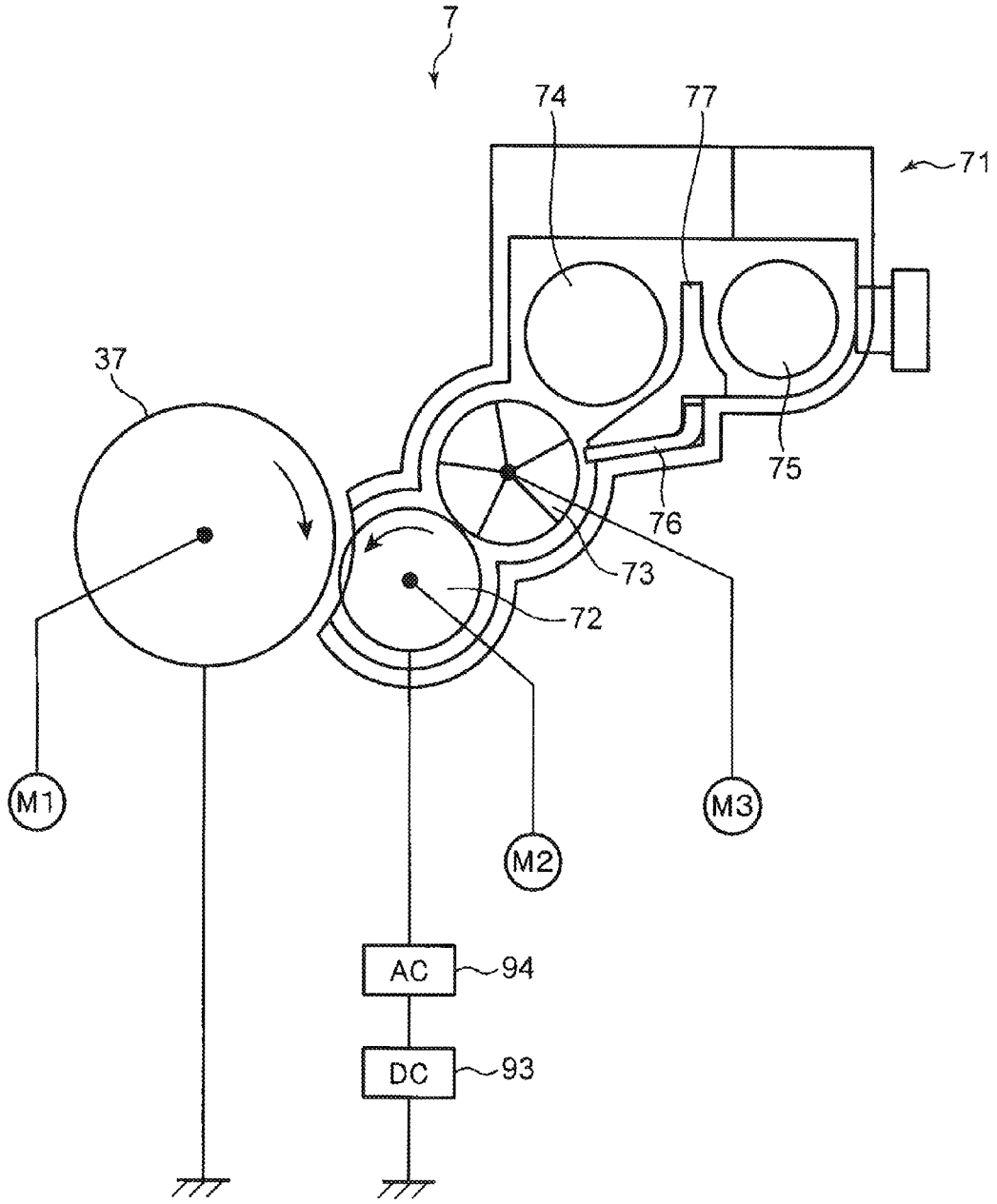
FIG. 2 is a cross-sectional view illustrating a schematic structure of a developing device.

Next, a structure of the developing device 71 is described. FIG. 2 is a cross-sectional view illustrating a schematic structure of the developing device 71. Note that the developing devices 71 of the image forming units 7K, 7C, 7M and 7Y have the same structure.

The developing device 71 includes a developing roller 72 (developer carrier), a magnetic roller 73, a paddle mixer 74, a stirring mixer 75, a bristle cutting blade 76, a partition plate 77, a DC power supply portion 93, and an AC power supply portion 94. The photosensitive drum 37 is driven by a drum motor M1, and the developing roller 72 is driven by a developing motor M2. In other words, the photosensitive drum 37 and the developing roller 72 are independently driven.

The developing roller 72 is disposed at a position opposed to the photosensitive drum 37. The developing roller 72 carries and conveys the toner (developer) on the circumferential surface so as to supply the toner to the circumferential surface of the photosensitive drum 37. In this way, the latent image formed in advance on the circumferential surface of the photosensitive drum 37 becomes visible (developed) as the toner image. In addition, a magnet is embedded in the developing roller 72 so that magnetic poles are formed at a position opposed to the magnetic roller 73. The magnetic roller 73 forms a magnetic brush with the magnet disposed inside so as to supply the toner to the developing roller 72.

The paddle mixer 74 and the stirring mixer 75 have spiral wings, which conveys and stirs the toner in directions opposite to each other so as to charge the toner. Further, the paddle mixer 74 supplies the charged toner to the magnetic roller 73. The bristle cutting blade 76 restricts a thickness of the magnetic brush formed on the magnetic roller 73. The partition plate 77 is disposed between the paddle mixer 74 and the stirring mixer 75 so that the toner can pass through freely outside both ends of the partition plate 77.

The toner charged by the paddle mixer 74 and the stirring mixer 75 is supplied to the magnetic roller 73. The toner supplied to the magnetic roller 73 is conveyed as the magnetic brush formed by the magnet inside the magnetic roller 73. After that, the magnetic brush is moved by rotation of a sleeve on a surface of the magnetic roller 73, and a thickness thereof is restricted when passing through between the bristle cutting blade 76 and the magnetic roller 73.

The DC power supply portion 93 applies a DC voltage to the developing roller 72. The AC power supply portion 94 applies an AC voltage to the developing roller 72. The DC voltage output from the DC power supply portion 93 and the AC voltage output from the AC power supply portion 94 are added to be a developing bias voltage, which is applied to the developing roller 72. Then, a potential difference is generated between the photosensitive drum 37 and the developing roller 72. This potential difference enables the toner carried on the circumferential surface of the developing roller 72 to be supplied to the photosensitive drum 37 so that the latent image formed on the photosensitive drum 37 is developed.

First Embodiment

Figure 3A:
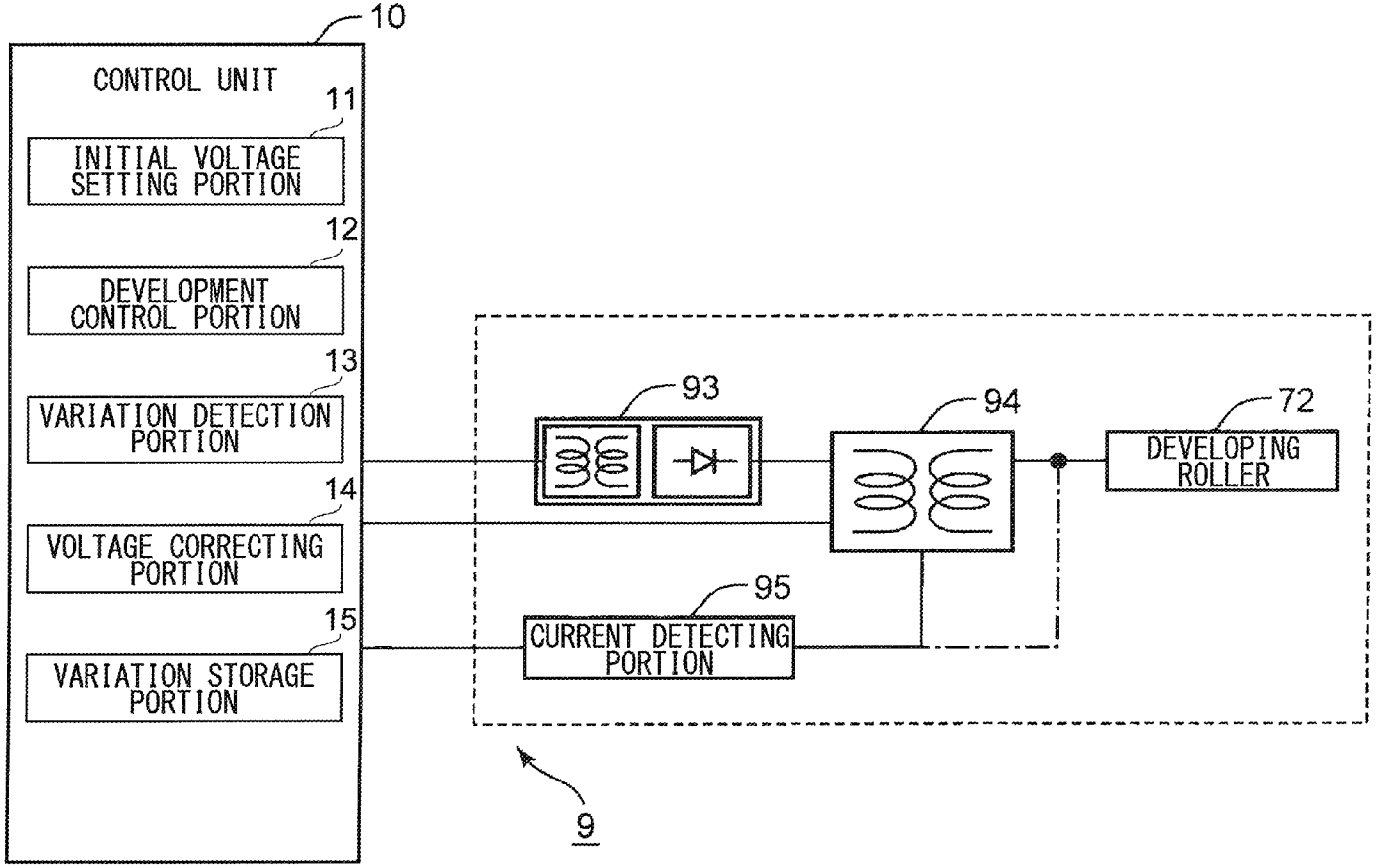
FIG. 3A is a block diagram illustrating an example of an electric structure of a power supply unit according to a first embodiment of the present disclosure.

Hereinafter, details of a power supply unit 9 according to a first embodiment of the present disclosure are described. FIG. 3A is a block diagram illustrating an example of an electric structure of the power supply unit 9 according to an embodiment of the present disclosure.

As illustrated in FIG. 3A, the power supply unit 9 includes the DC power supply portion 93, the AC power supply portion 94, a current detecting portion 95, and the control unit 10.

A control signal output from a development control portion 12 described later is input to the DC power supply portion 93. The DC power supply portion 93 transforms the AC voltage supplied from an AC power source such as a commercial power source to an AC voltage having a predetermined level and then rectifies the AC voltage by a rectifying circuit. In this way, the DC power supply portion 93 outputs a DC voltage having a level indicated by the input control signal (predetermined level). Thus, the DC power supply portion 93 outputs the DC voltage that is gradually stabilized at the level indicated by the control signal via the process of transforming the AC voltage supplied from the AC power source after the control signal is input. Note that this method of outputting the DC voltage by the DC power supply portion 93 is not a limitation.

A control signal output from the development control portion 12 described later is input to the AC power supply portion 94. The AC power supply portion 94 converts the AC voltage supplied from an AC power source such as a commercial power source into a DC voltage having a predetermined level and then further converts the DC voltage into an AC voltage having predetermined levels of a peak voltage and a duty ratio indicated by the input control signal. In this way, the AC power supply portion 94 generates the AC voltage that is gradually stabilized at the level indicated by the control signal (predetermined level) via the step of converting the AC voltage supplied from an AC power source such as a commercial power source into a DC voltage after the control signal is input. Note that this method of generating the AC voltage by the AC power supply portion 94 is not a limitation. The AC power supply portion 94 adds the generated AC voltage and the DC voltage output from the DC power supply portion 93 to be the developing bias voltage, which is applied to the developing roller 72.

The current detecting portion 95 detects a current value (current) of the current input to the developing roller 72. For instance, as illustrated in FIG. 3A, the current detecting portion 95 is connected to the AC power supply portion 94 so as to detect a current value of the current flowing to the output terminal of the AC power supply portion 94. Instead, as illustrated in FIG. 3A with a dot-dashed line, the current detecting portion 95 may be connected to the line connecting the AC power supply portion 94 and the developing roller 72.

The DC power supply portion 93, the AC power supply portion 94, the current detecting portion 95, and the developing roller 72, which are illustrated in FIG. 3A with a broken line box, are provided to each of the black unit 7K, the cyan unit 7C, the magenta unit 7M, and the yellow unit 7Y and have the same structures.

Concerning control of the developing bias voltage, the control unit 10 functions as an initial voltage setting portion 11, the development control portion 12, a voltage correcting portion 14, a variation detection portion 13, and a variation storage portion 15, in particular.

The initial voltage setting portion 11 sets an initial level of the DC voltage output from the DC power supply portion 93. In addition, the initial voltage setting portion 11 sets an initial level of the AC voltage output from the AC power supply portion 94. Specifically, on the basis of experimental values of a test operation or the like, the initial level of the DC voltage and the initial level of the AC voltage to be applied to the developing roller 72 for moving the toner of each color from the developing roller 72 to the photosensitive drum 37 are determined in advance and are stored in the ROM or the like.

FIG. 4A is a schematic diagram illustrating an example of a waveform of the developing bias voltage. For instance, as illustrated in FIG. 4A, the initial voltage setting portion 11 obtains "200 V" as the initial level of the DC voltage from the ROM or the like and obtains a peak voltage of "1.5 kV" and a duty ratio of "30%" as the initial level of the AC voltage. Note that the AC voltage level may be determined by an amplitude, a root mean square value, a frequency, and the like instead of the peak voltage and the duty ratio.

The initial voltage setting portion 11 stores the initial level of the DC voltage obtained from the ROM or the like in the RAM so as to set the initial level of the DC voltage. In the same manner, the initial voltage setting portion 11 stores the initial level of the AC voltage obtained from the ROM or the like in the RAM so as to set the initial level of the AC voltage.

The development control portion 12 controls the DC power supply portion 93 to apply the DC voltage having a level stored in the RAM by the initial voltage setting portion 11 and the voltage correcting portion 14 described later to the developing roller 72. Specifically, the development control portion 12 obtains the DC voltage level stored in the RAM and outputs the control signal indicating the obtained DC voltage level to the DC power supply portion 93. In this way, the DC power supply portion 93 applies the developing roller 72 with the DC voltage that is gradually stabilized at the level indicated by the control signal.

In addition, the development control portion 12 controls the AC power supply portion 94 to apply the AC voltage having a level stored in the RAM by the initial voltage setting portion 11 and the voltage correcting portion 14 described later to the developing roller 72. Specifically, the development control portion 12 obtains the AC voltage level stored in the RAM and outputs the control signal indicating the obtained AC voltage level to the AC power supply portion 94. In this way, the AC power supply portion 94 applies the developing roller 72 with the AC voltage that is gradually stabilized at the level indicated by the control signal. Details of operation of the development control portion 12 will be described later.

The variation detection portion 13 detects a variation of the current value detected by the current detecting portion 95. Specifically, the variation detection portion 13 subtracts the current value detected last time from the current value detected by the current detecting portion 95 and detects a result of the subtraction as the variation of the current value. Then, the variation detection portion 13 outputs detection data indicating a variation of the detected current value.

In other words, when the current value detected by the current detecting portion 95 is increased from the current value detected last time, the variation detection portion 13 outputs the detection data indicating a positive (+) value. On the other hand, when the current value detected by the current detecting portion 95 is decreased from the current value detected last time, the variation detection portion 13 outputs the detection data indicating a negative (−) value.

For instance, it is supposed that the current value detected last time is "100 μA" and the current value detected this time is "110 μA". In this case, the variation detection portion 13 outputs the detection data indicating a variation of "+10 μA". On the other hand, it is supposed that the current value detected last time is "110 μA" and the current value detected this time is "100 μA". In this case, the variation detection portion 13 outputs the detection data indicating a variation of "−10 μA".

The voltage correcting portion 14 increases or decreases a level of the DC voltage stored in the RAM (at least one of the DC voltage and the AC voltage) in accordance with the variation detected by the variation detection portion 13 using the correction data stored in the variation storage portion 15 described later.

The variation storage portion 15 is constituted of a part of the ROM storage area. The variation storage portion 15 stores the correction data indicating an increasing or decreasing amount of the DC voltage level by the voltage correcting portion 14 in accordance with the variation, in association with the variation detected by the variation detection portion 13.

Hereinafter, the voltage correcting portion 14 and the variation storage portion 15 are described in detail. FIG. 5 is a schematic diagram illustrating an example of the correction data stored in the variation storage portion 15.

For instance, as illustrated in FIG. 5, the variation storage portion 15 stores correction data of "DC-20 V" indicating that the DC voltage level should be decreased by "20 V" in association with a variation of "+10 μA" indicating that the current is increased by "10 μA". In addition, the variation storage portion 15 stores correction data of "DC-25 V" indicating that the DC voltage level should be decreased by "25 V" in association with a variation of "+20 μA" indicating that the current is increased by "20 μA".

In this way, the variation storage portion 15 stores the correction data indicating that the DC voltage level should be decreased more as the variation indicating a positive value is larger, namely, as the current value detected by the current detecting portion 95 increases more.

In addition, the variation storage portion 15 stores correction data of "DC+20 V" indicating that the DC voltage level should be increased by "20 V" in synchronization with a variation of "−10 μA" indicating that the current is decreased by "10 μA". In addition, the variation storage portion 15 stores correction data of "DC+25 V" indicating that the DC voltage level should be increased by "25 V" in association with a variation of "−20 μA" indicating that the current is decreased by "20 μA".

In this way, the variation storage portion 15 stores the correction data indicating that the DC voltage level should be increased more as the variation indicating a negative value is smaller, namely, as the current value detected by the current detecting portion 95 decreases more.

The voltage correcting portion 14 obtains the correction data stored in the variation storage portion 15 in association with the variation indicated by the detection data output from the variation detection portion 13, and increases or decreases the DC voltage level stored in the RAM by the amount indicated by the obtained correction data. In this way, the voltage correcting portion 14 increases or decreases the DC voltage level in accordance with the variation indicated by the detection data output from the variation detection portion 13.

For instance, as illustrated in FIG. 5, it is supposed that the variation storage portion 15 stores the correction data. In addition, it is supposed that the detection data output from the variation detection portion 13 indicates a variation of "+10 μA". In this case, the voltage correcting portion 14 obtains the correction data of "DC−20 V" stored in the variation storage portion 15 in association with the variation of "+10 μA". Then, the voltage correcting portion 14 decreases the DC voltage level stored in the RAM by "20 V" indicated by the obtained correction data. When the detection data output from the variation detection portion 13 indicates the variation of "+20 μA", the voltage correcting portion 14 obtains the correction data of "DC−25 V" stored in the variation storage portion 15 in association with the variation of "+20 μA" and decreases the DC voltage level stored in the RAM by "25 V".

In this way, the voltage correcting portion 14 decreases the DC voltage level to be applied to the developing roller 72 more as the current value detected by the current detecting portion 95 increases more, as indicated by the correction data stored in the variation storage portion 15.

On the other hand, it is supposed that the detection data indicates the variation of "−10 μA". In this case, the voltage correcting portion 14 obtains the correction data of "DC+20 V" stored in the variation storage portion 15 in association with the variation of "−10 μA", and increases the DC voltage level stored in the RAM by "20 V" indicated by the obtained correction data. When the detection data indicates the variation of "−20 μA", the voltage correcting portion 14 obtains the correction data of "DC+25 V" stored in the variation storage portion 15 in association with the variation of "−20 μA" and increases the DC voltage level stored in the RAM by "25 V".

In this way, the voltage correcting portion 14 increases the DC voltage level to be applied to the developing roller 72 more as the current value detected by the current detecting portion 95 decreases more, as indicated by the correction data stored in the variation storage portion 15.

In other words, it is considered that a load of the developing roller 72 is decreased more as the current input to the developing roller 72 increases more. Accordingly, the voltage correcting portion 14 decreases the DC voltage to be applied to the developing roller 72 more as an increase amount of the current is larger. On the contrary, it is considered that the load of the developing roller 72 is increased more as the current input to the developing roller 72 decreases more. Accordingly, the voltage correcting portion 14 increases the voltage to be applied to the developing roller 72 more as a decrease amount of the current is larger.

Note that a variation of the load of the developing roller 72 occurs due to a variation of a distance between the developing roller 72 and the photosensitive drum 37, for example. The variation of the distance occurs due to, for example, a variation of a layer thickness of toner on the developing roller 72 or an eccentricity of the developing roller 72 or the photosensitive drum 37. When the above-mentioned distance is decreased, a capacitance between the developing roller 72 and the photosensitive drum 37 increases, and hence the load of the developing roller 72 increases. On the other hand, when the distance is increased, the capacitance between the developing roller 72 and the photosensitive drum 37 is decreased, and hence the load of the developing roller 72 is decreased.

Figure 6A:
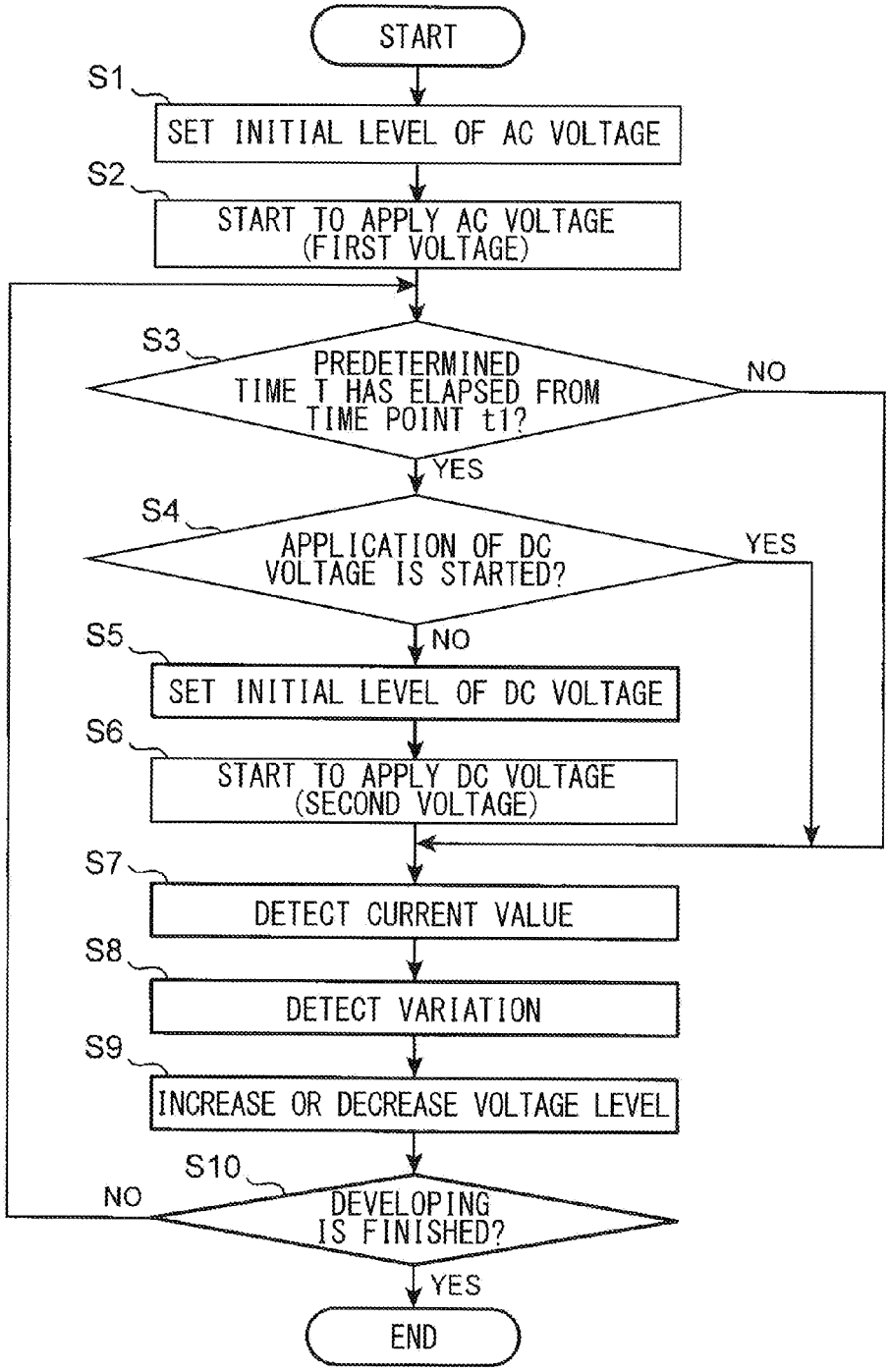
FIG. 6A is a flowchart illustrating an operation of applying the developing bias voltage of the first embodiment.

Hereinafter, the operation of applying the developing bias voltage is described. FIG. 6A is a flowchart illustrating the operation of applying the developing bias voltage. In the following description, it is supposed that the variation storage portion 15 stores the correction data indicating the increasing or decreasing amount of only the DC voltage level without increasing or decreasing the AC voltage level, in association with the variation, similarly to the correction data illustrated in FIG. 5. In other words, it is supposed that the voltage correcting portion 14 increases or decreases only the DC voltage level stored in the RAM in accordance with a variation of the current detected by the variation detection portion 13.

It is supposed that when the control unit 10 receives a print job including image data from the external computer or the like, the image forming unit 7 starts an image forming operation, and a developing operation is started in a process of the image forming operation. In this case, as illustrated in FIG. 6A, the initial voltage setting portion 11 obtains the initial level of the AC voltage to be applied to the developing roller 72 stored in the ROM or the like and stores the obtained initial level of the AC voltage in the RAM. In this way, the initial voltage setting portion 11 sets the initial level of the AC voltage (S1).

Then, the development control portion 12 starts to output the control signal indicating the AC voltage (first voltage) level stored in the RAM to the AC power supply portion 94. In this way, the development control portion 12 controls the AC power supply portion 94 to start to apply the AC voltage having the level indicated by the control signal (S2). After that, the development control portion 12 continues to output the control signal indicating the AC voltage level stored in the RAM during the period until the developing operation is finished.

In the case where a predetermined time T has not elapsed from time point t1 (first time point) when the application of the AC voltage is started in Step S2 (NO in S3), the development control portion 12 does not output the control signal indicating the DC voltage level to the DC power supply portion 93. In this case, Step S7 described later is performed in the state where the DC voltage is not applied to the developing roller 72 and only the AC voltage is applied to the developing roller 72.

The predetermined time T is determined to be an elapsed time from start of the application of the AC voltage until the AC voltage is stabilized, which is measured in advance without applying the DC voltage to the developing roller 72, for example, in an experiment of the test operation or the like. The predetermined time T is stored in advance in the ROM or the like.

On the other hand, in the case where the predetermined time T has elapsed from the time point t1 (YES in S3) and application of the DC voltage is not started (NO in S4), the initial voltage setting portion 11 obtains the initial level of the DC voltage to be applied to the developing roller 72 stored in the ROM or the like. The initial voltage setting portion 11 stores the obtained initial level of the DC voltage in the RAM so as to set the initial level of the DC voltage (S5).

Then, the development control portion 12 starts to output the control signal indicating a level of the DC voltage (second voltage) stored in the RAM to the DC power supply portion 93. In this way, the development control portion 12 controls the DC power supply portion 93 to start the application of the DC voltage having the level indicated by the control signal at a time point (second time point) when the predetermined time T has elapsed from the time point t1 (S6). After that, the development control portion 12 continues to output the control signal indicating the DC voltage level stored in the RAM during the period until the developing operation is finished.

After the application of the AC voltage is started in Step S2, the current detecting portion 95 detects a current value of the current input to the developing roller 72 regardless of whether or not the application of the DC voltage is started (S7).

The variation detection portion 13 detects the variation of the current value by using the current value detected in Step S7 and the current value detected last time (having an initial value of 0) stored in the RAM, and outputs the detection data indicating the detected variation (S8). When outputting the detection data in Step S8, the variation detection portion 13 stores the current value detected in Step S7 as the current value detected last time in the RAM.

Next, as described above, the voltage correcting portion 14 obtains the correction data stored in the variation storage portion 15 in association with the variation indicated by the detection data output in Step S8, and increases or decreases the DC voltage level stored in the RAM by the amount indicated by the obtained correction data (S9).

In this way, when the application of the DC voltage in Step S6 is started, the development control portion 12 outputs the control signal indicating the increased or decreased DC voltage level stored in the RAM is output to the DC power supply portion 93. As a result, the DC voltage having the increased or decreased DC voltage level is applied to the developing roller 72. On the other hand, when the application of the DC voltage in Step S6 is not started, the development control portion 12 does not output the control signal indicating the DC voltage level, and hence only the DC voltage level stored in the RAM is increased or decreased.

After performing Step S9, when the developing operation is not finished (NO in S10), the process of Step S3 and following steps is repeated.

Figure 7A:
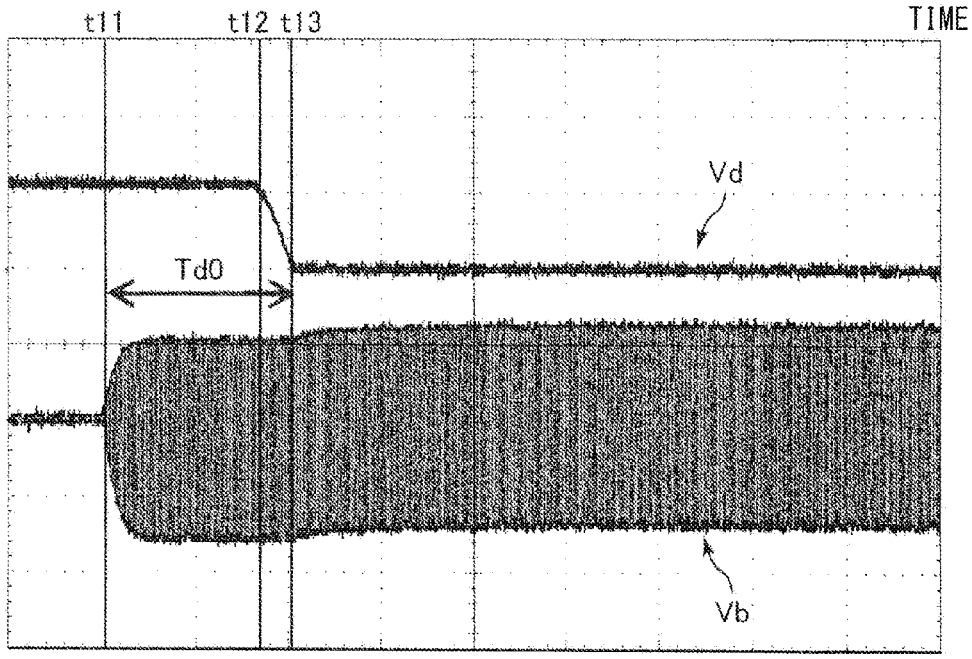
FIG. 7A is a schematic diagram illustrating an example of waveforms of a DC voltage and the developing bias voltage when application of the DC voltage and application of the AC voltage are simultaneously started.
Figure 7B:
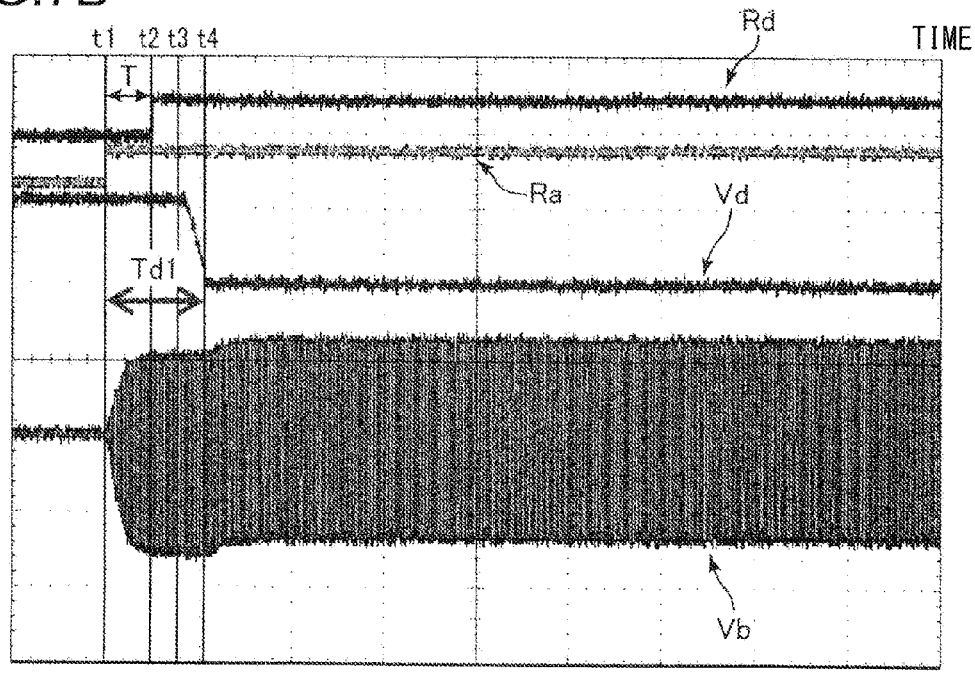
FIG. 7B is a schematic diagram illustrating an example of waveforms of the DC voltage and the developing bias voltage when the application of the DC voltage is started a predetermined time after start of the application of the AC voltage.

Hereinafter, an example of waveforms of the DC voltage Vd and the developing bias voltage Vb in the developing operation is described. FIG. 7A is a schematic diagram illustrating an example of waveforms of the DC voltage Vd and the developing bias voltage Vb when the application of the DC voltage and the application of the AC voltage are simultaneously started. FIG. 7B is a schematic diagram illustrating an example of waveforms of the DC voltage Vd and the developing bias voltage Vb when the application of the DC voltage is started after the predetermined time T elapses from start of the application of the AC voltage.

In FIGS. 7A and 7B, a level of the DC voltage Vd is lower in the upper side while it is higher in the lower side. On the other hand, a level of the developing bias voltage Vb is higher in the upper side while it is lower in the lower side.

For instance, it is supposed that the application of the AC voltage and the application of the DC voltage are simultaneously started at time point t11 similarly to the conventional structure. In this case, as illustrated in FIG. 7A, the current input to the developing roller 72 is largely increased in the transition period from the time point t11 to time point t12 when the AC voltage level is stabilized. For this reason, the voltage correcting portion 14 decreases a level of the DC voltage Vd stored in the RAM down to zero or lower. As a result, the DC voltage Vd is not output.

When the AC voltage is stabilized at the time point t12, the current input to the developing roller 72 is gradually decreased, and hence the voltage correcting portion 14 gradually increases the level of the DC voltage Vd stored in the RAM up to the initial level. As a result, the DC voltage Vd is gradually increased up to the initial level.

Then, when the current input to the developing roller 72 is stabilized at time point t13, the voltage correcting portion 14 does not substantially increase or decrease the level of the DC voltage Vd stored in the RAM. As a result, the DC voltage Vd is stabilized at the initial level.

In other words, the application of the AC voltage and the application of the DC voltage are simultaneously started, the developing bias voltage Vb in which the DC voltage of the initial level and the AC voltage of the initial level are added is applied to the developing roller 72 at the time point when time Td0 has elapsed from the time point t11 when the application is started (at the time point t13).

In contrast, in the structure of this embodiment, as illustrated in FIG. 7B, output of a control signal Ra indicating the initial level of the AC voltage to the AC power supply portion 94 is started at the time point t1 in Step S2 (FIG. 6A). In this way, only the application of the AC voltage is started at the time point t1. Then, at time point t2 when the predetermined time T has elapsed from the time point t1 so that the AC voltage is considered to be stabilized at the initial level indicated by the control signal Ra, output of a control signal Rd indicating the DC voltage of the initial level to the DC power supply portion 93 is started in Step S6 (FIG. 6A). In this way, the application of the DC voltage is started at the time point t2.

In the period from the time point t2 to time point t3 when the AC voltage level is actually stabilized, the voltage correcting portion 14 slightly decreases the level of the DC voltage Vd stored in the RAM due to a small increase of the current input to the developing roller 72.

When the AC voltage level is actually stabilized at the time point t3, the voltage correcting portion 14 gradually increases the level of the DC voltage Vd stored in the RAM up to the initial level in Step S9 (FIG. 6A) due to a gradual decrease of the current input to the developing roller 72. As a result, the DC voltage Vd is gradually increased to the initial level.

Further, when the current input to the developing roller 72 is stabilized at time point t4, the voltage correcting portion 14 does not increase or decrease the level of the DC voltage Vd stored in the RAM. As a result, the DC voltage Vd is stabilized at the initial level.

In other words, in the structure of this embodiment, the developing bias voltage Vb in which the DC voltage of the initial level and the AC voltage of the initial level are added is applied to the developing roller 72 at the time point when time Td1 shorter than the time Td0 has elapsed from the time point t1 (at the time point t4).

In this way, according to the structure of the embodiment described above, the application of the DC voltage is started at the time point t2 when the predetermined time T has elapsed from the time point t1 when the application of the AC voltage is started. Accordingly, even if the current value of the current to be input to the developing roller 72 is increased during the period from start of the application of the AC voltage to the time point t2, it is possible not to perform the correction of decreasing the DC voltage level during the period.

In this way, the DC voltage level is not decreased temporarily during the period, and it is possible to decrease the possibility that the time necessary for both the DC voltage and the AC voltage to be stabilized at the initial level becomes longer than a total time of the time necessary for the DC voltage to be stabilized at the initial level and the time necessary for the AC voltage to be stabilized at the initial level, when the DC voltage and the AC voltage are individually applied one by one. As a result, the developing bias voltage to be applied to the developing roller 72, in which the DC voltage and the AC voltage are added, can be quickly stabilized.

In addition, in the embodiment described above, the predetermined time T is determined to be the elapsed time from the time point t1 until the time point when the AC voltage is stabilized, which is measured in advance without applying the DC voltage.

Accordingly, it is possible not to perform the correction of decreasing the DC voltage level during the period from the time point t1 when the application of the AC voltage is started until the predetermined time T elapses, namely the period from the start of the application of the AC voltage until the time point when the AC voltage is considered to be stabilized, even if current value of the current input to the developing roller 72 is increased. In this way, it is possible to decrease the period for performing the correction of decreasing the DC voltage level.

As a result, it is possible to reduce a possibility that the time necessary for stabilizing both the DC voltage and the AC voltage to the initial levels is longer than the total time of the time necessary for stabilizing the DC voltage to the initial level and the time necessary for stabilizing the AC voltage to the initial level when the DC voltage and the AC voltage are applied individually one by one.

In addition, unlike the structure of the embodiment described above, when the application of the DC voltage is started earlier than the application of the AC voltage, the toner carried on the developing roller 72 may be scattered when the application of the voltage to the developing roller 72 is started.

However, because the application of the AC voltage is started earlier than the application of the DC voltage according to the structure of the embodiment described above, the toner carried on the developing roller 72 can be moved between the developing roller 72 and the photosensitive drum 37 when the application of the voltage to the developing roller 72 is started. In this way, it is possible to reduce a possibility that the toner carried on the developing roller 72 is scattered when the application of the voltage to the developing roller 72 is started.

Note that the first embodiment described above is merely an example of the embodiment according to the present disclosure, and the present disclosure is not limited to the embodiment described above. For instance, the following modified embodiments may be adopted.

(1) The control unit 10 may be constituted of a control circuit such as an ASIC that can perform the same control as described above instead of the structure in which the control program is executed for controlling operations of the individual portions as described above in the embodiment.

(2) The predetermined time T may be determined to be an elapsed time from the time point (first time point) when the application of the AC voltage is started until the time point when the current detected by the current detecting portion 95 is stabilized, namely, until the variation detected by the variation detection portion 13 becomes substantially zero, which is measured in advance without applying the DC voltage to the developing roller 72, for example, in an experiment such as a test operation.

According to the structure of this modified embodiment, it is possible not to perform the correction of decreasing the DC voltage level during the period from the time point when the application of the AC voltage is started until the predetermined time T elapses, namely, the period from the start of the application of the AC voltage until the time point when the current detected by the current detecting portion 95 is considered to be stabilized, even if the current value of the current input to the developing roller 72 is increased. In this way, it is possible to eliminate the period while the correction of decreasing the DC voltage level is performed.

As a result, it is possible to reduce a possibility that the time until both the DC voltage and the AC voltage are stabilized at the initial levels becomes longer than the total time of the time necessary until the DC voltage is stabilized at the initial level and the time necessary until the AC voltage is stabilized at the initial level, when the DC voltage and the AC voltage are applied individually one by one.

(3) The variation storage portion 15 may store the correction data indicating that both the DC voltage level and the AC voltage level should be decreased more as the variation indicating the positive value is larger, namely, as the current value detected by the current detecting portion 95 increases more, in association with the variation. In association with this, the voltage correcting portion 14 may decrease the DC voltage level and the AC voltage level to be applied to the developing roller 72 more as the current value detected by the current detecting portion 95 increases more, using the correction data stored in the variation storage portion 15, in Step S9 (FIG. 6A).

Alternatively, the variation storage portion 15 may store the correction data indicating that only the AC voltage level should be decreased more as the variation indicating the positive value is larger, namely, as the current value detected by the current detecting portion 95 increases more, in association with the variation. In association with this, the voltage correcting portion 14 may decrease the AC voltage level to be applied to the developing roller 72 more as the current value detected by the current detecting portion 95 increases more, using the correction data stored in the variation storage portion 15, in Step S9 (FIG. 6A).

In other words, the variation storage portion 15 may store the correction data indicating that at least one of voltage levels of the DC voltage and the AC voltage should be decreased more as the variation indicating the positive value is larger, namely, as the current value detected by the current detecting portion 95 increases more, in association with the variation. In association with this, the voltage correcting portion 14 may decrease at least one of voltage levels of the DC voltage and the AC voltage to be applied to the developing roller 72 more as the current value detected by the current detecting portion 95 increases more, using the correction data.

(4) In the embodiment and the modified embodiments described above, the application of the DC voltage is started the predetermined time T after the time point (the time point t1) when the application of the AC voltage to the developing roller 72 is started. On the contrary to this, it is possible that the application of the DC voltage (first voltage) to the developing roller 72 is started first, and the application of the AC voltage (second voltage) is started a predetermined time after the time point when the application of the DC voltage is started.

In association with this, the predetermined time in this modified embodiment may be determined to be the elapsed time from the time point (first time point) when the application of the DC voltage is started until the time point when the DC voltage is stabilized, measured in advance without applying the AC voltage to the developing roller 72, for example, in an experiment such as the test operation. In addition, the predetermined time may be determined to be the elapsed time from the time point (first time point) when the application of the DC voltage is started until the current detected by the current detecting portion 95 is stabilized, namely, until the variation detected by the variation detection portion 13 becomes substantially zero, which is measured in advance without applying the AC voltage to the developing roller 72, for example.

As described above, a method for applying a voltage with the power supply unit 9 according to this embodiment includes: starting application of a first voltage as one of a DC voltage and an AC voltage at a first time point; and starting application of a second voltage as the other of the DC voltage and the AC voltage at a second time point that is a predetermined time after the first time point, when applying a voltage to the developing roller 72 (developer carrier).

In this way, it is possible to reduce a possibility that the time necessary until both the DC voltage and the AC voltage are stabilized at the initial levels becomes longer than the total time of the time necessary until the DC voltage is stabilized at the initial level and the time necessary until the AC voltage is stabilized at the initial level when the DC voltage and the AC voltage are applied individually one by one.

In other words, according to this first embodiment, it is possible to provide the power supply unit, the image forming apparatus, and the method for applying a voltage, in which the voltage applied to the developer carrier can be quickly stabilized.

Second Embodiment

A "target level" that is a stabilized level and an "initial level" that is applied at an initial stage and is higher than the target level are set as levels of the voltage to be applied. When the operation is started, the voltage of the initial level is applied so that the target level can be achieved early. Accordingly, an embodiment having a structure in which the "target level" as the stabilized level and the "initial level" higher than the target level are used for control as the voltage to be applied is described as a second embodiment.

Figure 3B:
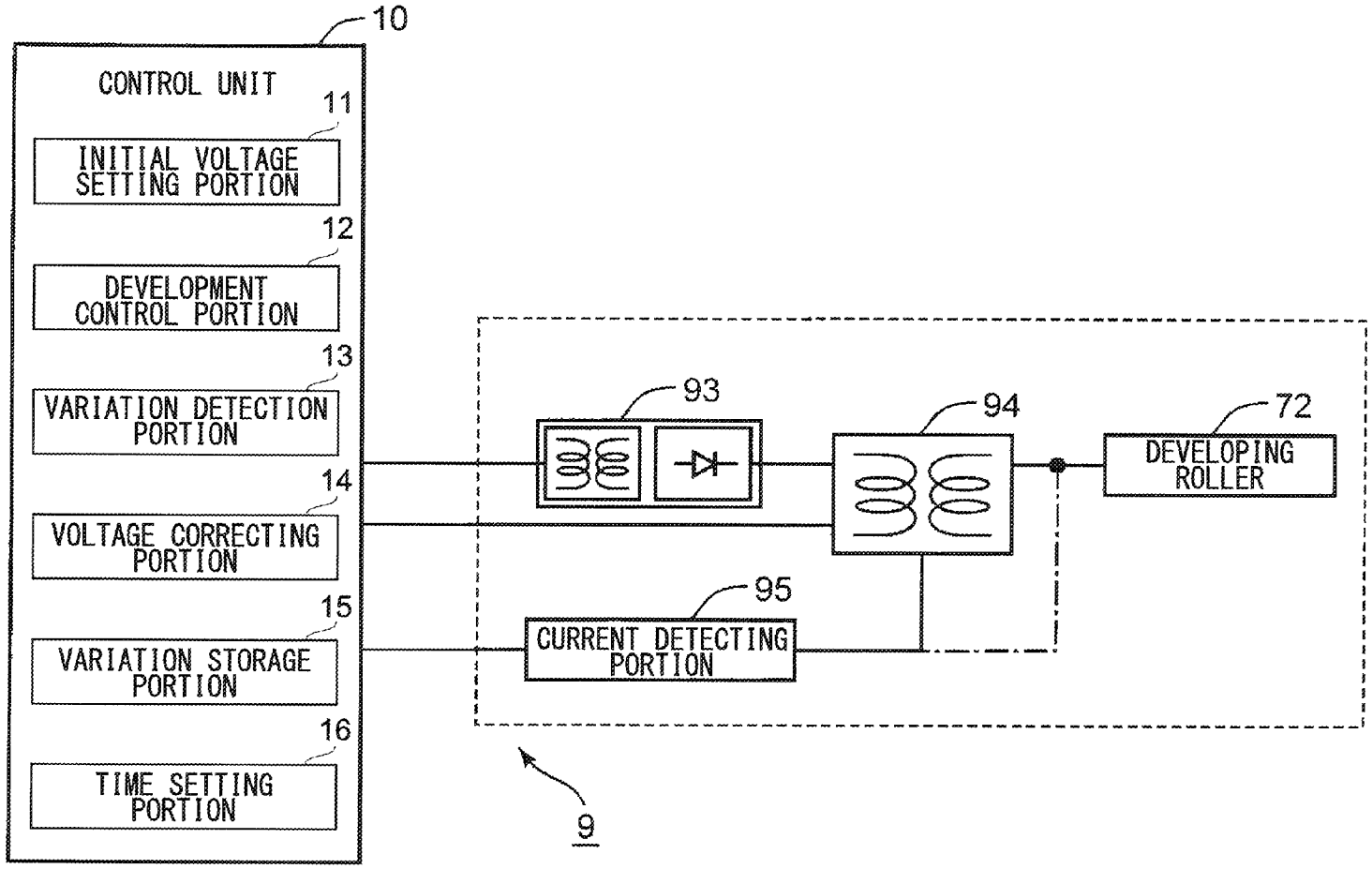
FIG. 3B is a block diagram illustrating an example of an electric structure of a power supply unit according to a second embodiment of the present disclosure.

Hereinafter, details of the power supply unit 9 according to the second embodiment of the present disclosure are described. FIG. 3B is a block diagram illustrating an example of an electric structure of the power supply unit 9 according to an embodiment of the present disclosure.

As illustrated in FIG. 3B, the power supply unit 9 includes the DC power supply portion 93, the AC power supply portion 94, the current detecting portion 95, and the control unit 10.

A control signal output from the development control portion 12 that is described later is input to the DC power supply portion 93. The DC power supply portion 93 transforms the AC voltage supplied from an AC power source such as a commercial power source into an AC voltage having a predetermined level and then rectifies the AC voltage with the rectifying circuit. In this way, the DC power supply portion 93 outputs the DC voltage having a level indicated by the input control signal (predetermined level). Thus, the DC power supply portion 93 outputs the DC voltage that is gradually stabilized at the level indicated by the control signal via a process of transforming the AC voltage supplied from the AC power source after the control signal is input. Note that this output method of the DC voltage by the DC power supply portion 93 is not a limitation.

A control signal output from the development control portion 12 that is described later is input to the AC power supply portion 94. The AC power supply portion 94 converts the AC voltage supplied from an AC power source such as a commercial power source into a DC voltage having a predetermined level and then further converts the DC voltage into an AC voltage having a predetermined level such as a peak voltage and a duty ratio indicated by the input control signal. In this way, the AC power supply portion 94 generates the AC voltage that is gradually stabilized at a level indicated by the control signal (predetermined level) via the process of converting the AC voltage supplied from the AC power source into the DC voltage after the control signal is input. Note that this method of generating the AC voltage by the AC power supply portion 94 is not a limitation. The AC power supply portion 94 applies the developing roller 72 with the voltage in which the generated AC voltage and the DC voltage output from the DC power supply portion 93 are added as the developing bias voltage.

The current detecting portion 95 detects the current value of the AC current input to the developing roller 72. For instance, as illustrated in FIG. 3B, the current detecting portion 95 is connected to the AC power supply portion 94 so as to detect a current value of the AC current flowing to the output terminal of the AC power supply portion 94. Instead of this, as illustrated in FIG. 3B with a dot-dashed line, the current detecting portion 95 may be connected to the line connecting the AC power supply portion 94 and the developing roller 72, so as to detect the current value of the AC current.

The DC power supply portion 93, the AC power supply portion 94, the current detecting portion 95, and the developing roller 72, which are illustrated in FIG. 3B with a broken line box, are provided to each of the black unit 7K, the cyan unit 7C, the magenta unit 7M, and the yellow unit 7Y and have the same structures.

Concerning control of the developing bias voltage, the control unit 10 functions as the initial voltage setting portion 11, the development control portion 12, the variation detection portion 13, the voltage correcting portion 14, the variation storage portion 15, and a time setting portion 16, in particular.

The initial voltage setting portion 11 sets the target level of the DC voltage (DC target level) output from the DC power supply portion 93. In addition, the initial voltage setting portion 11 sets the target level of the AC voltage (AC target level) output from the AC power supply portion 94. Specifically, on the basis of experimental values of a test operation or the like, the target level of the DC voltage and the target level of the AC voltage to be applied to the developing roller 72, which are necessary for moving the toner of each color from the developing roller 72 of each color to the photosensitive drum 37, are determined in advance and are stored in the ROM or the like.

FIG. 4B is a schematic diagram illustrating an example of a waveform of the developing bias voltage. For instance, as illustrated in FIG. 4B, the initial voltage setting portion 11 obtains "200 V" as the target level of the DC voltage from the ROM or the like and obtains a peak voltage of "1.25 kV" and a duty ratio of "30%" as the target level of the AC voltage. Note that the AC voltage level may be determined by an amplitude, a root mean square value, a frequency, and the like instead of the peak voltage and the duty ratio.

The initial voltage setting portion 11 stores the target level of the DC voltage obtained from the ROM or the like in the RAM so as to set the target level of the DC voltage. In the same manner, the initial voltage setting portion 11 stores the target level of the AC voltage obtained from the ROM or the like in the RAM so as to set the target level of the AC voltage.

The development control portion 12 controls the AC power supply portion 94 to start the application of the AC voltage of the initial level (high level) higher than the target level of the AC voltage stored in the RAM by the initial voltage setting portion 11.

Specifically, the development control portion 12 obtains the target level of the AC voltage stored in the RAM. The development control portion 12 determines that a level increased from the obtained target level by the predetermined level stored in advance in the ROM or the like as the initial level.

For instance, it is supposed that the target level of the AC voltage stored in the RAM by the initial voltage setting portion 11 indicates a peak voltage of "1.25 kV" and a duty ratio of "30%". In addition, it is supposed that the ROM or the like stores a peak voltage of "0.25 kV" as the predetermined level for increasing the target level. In this case, the development control portion 12 determines the peak voltage of "1.5 kV" increased from the peak voltage of "1.25 kV" by "0.25 kV" and the duty ratio of "30%" as the initial level of the AC voltage.

The development control portion 12 starts to output the control signal indicating the determined initial level to the AC power supply portion 94. In this way, the AC power supply portion 94 starts the application of the AC voltage that is gradually stabilized at the initial level indicated by the control signal to the developing roller 72.

In addition, the development control portion 12 controls the DC power supply portion 93 to start the application of the DC voltage of the target level stored in the RAM by the initial voltage setting portion 11 at the second time point that is a predetermined time after the first time point when the AC power supply portion 94 starts the application of the AC voltage of the initial level. Note that the development control portion 12 uses the same time as the set time stored in the RAM by the time setting portion 16 described later as the predetermined time.

Specifically, the development control portion 12 obtains the target level of the DC voltage stored in the RAM at the second time point and starts to output the control signal indicating the obtained target level of the DC voltage to the DC power supply portion 93. In this way, the DC power supply portion 93 starts to apply the developing roller 72 with the DC voltage that is gradually stabilized at the target level indicated by the control signal.

When the voltage correcting portion 14 described later increases or decreases the DC voltage level after the second time point, the development control portion 12 controls the DC power supply portion 93 to apply the developing roller 72 with the DC voltage having the increased or decreased level.

Specifically, the development control portion 12 changes the control signal output to the DC power supply portion 93 to the control signal indicating the increased or decreased DC voltage level every time when the voltage correcting portion 14 described later stores the increased or decreased DC voltage level in the RAM. In this way, the development control portion 12 controls the DC power supply portion 93 to apply the developing roller 72 with the increased or decreased DC voltage.

In addition, the development control portion 12 changes the AC voltage level to be applied to the AC power supply portion 94 to the target level of the AC voltage stored in the RAM by the initial voltage setting portion 11 at a third time point that is a predetermined set time after the first time point. Note that the set time is set by the time setting portion 16 that will be described later.

Specifically, the development control portion 12 changes the control signal to be output to the AC power supply portion 94 to the control signal indicating the target level of the AC voltage stored in the RAM at the third time point. In this way, the AC power supply portion 94 changes the AC voltage level to be applied to the developing roller 72 to the target level of the AC voltage indicated by the control signal.

The variation detection portion 13 detects the variation of the current value detected by the current detecting portion 95. Specifically, the variation detection portion 13 subtracts the current value detected last time from the current value detected by the current detecting portion 95 and detects the subtracted result as the variation of the current value. Then, the variation detection portion 13 outputs the detection data indicating the variation of the detected current value.

In other words, when the current value detected by the current detecting portion 95 is larger than the current value detected last time, the variation detection portion 13 outputs the detection data indicating a positive (+) value. On the other hand, when the current value detected by the current detecting portion 95 is smaller than the current value detected last time, the variation detection portion 13 outputs the detection data indicating a negative (−) value.

For instance, it is supposed that the current value detected last time is "100 μA" while the current value detected this time is "110 μA". In this case, the variation detection portion 13 outputs the detection data indicating the variation of "+10 μA". On the other hand, it is supposed that the current value detected last time is "110 μA" while the current value detected this time is "100 μA". In this case, the variation detection portion 13 outputs the detection data indicating the variation of "−10 μA".

The voltage correcting portion 14 increases or decreases the DC voltage level stored in the RAM in accordance with the variation detected by the variation detection portion 13 using the correction data stored in the variation storage portion 15 described later.

The variation storage portion 15 is constituted of a part of the storage area of the ROM. The variation storage portion 15 stores the correction data indicating the increasing or decreasing amount of the DC voltage level by the voltage correcting portion 14 in accordance with the variation, in association with the variation detected by the variation detection portion 13.

Hereinafter, the voltage correcting portion 14 and the variation storage portion 15 are described in detail. FIG. 5 is a schematic diagram illustrating an example of correction data stored in the variation storage portion 15.

For instance, as illustrated in FIG. 5, the variation storage portion 15 stores the correction data of "DC−20 V" indicating that the DC voltage level should be decreased by "20 V" in association with the variation of "+10 μA" indicating that the current is increased by "10 μA". In addition, the variation storage portion 15 stores the correction data of "DC−25 V" indicating that the DC voltage level should be decreased by "25 V" in association with the variation of "+20 μA" indicating that the current is increased by "20 μA".

In this way, the variation storage portion 15 stores the correction data indicating that the DC voltage level should be decreased more as the variation indicating the positive value is larger, namely, as the current value detected by the current detecting portion 95 increases more.

In addition, the variation storage portion 15 stores the correction data of "DC+20 V" indicating that the DC voltage level should be increased by "20 V", in association with the variation of "−10 μA" indicating that the current is decreased by "10 μA". In addition, the variation storage portion 15 stores the correction data of "DC+25 V" indicating that the DC voltage level should be increased by "25 V", in association with the variation of "−20 μA" indicating that the current is decreased by "20 μA".

In this way, the variation storage portion 15 stores the correction data indicating that the DC voltage level should be increased more as the variation indicating the negative value is smaller, namely, as the current value detected by the current detecting portion 95 is decreased more.

The voltage correcting portion 14 obtains the correction data stored in the variation storage portion 15 in association with the variation indicated by the detection data output from the variation detection portion 13 and the target level of the DC voltage stored in the RAM by the initial voltage setting portion 11. Then, the voltage correcting portion 14 increases or decreases the obtained target level of the DC voltage by the amount indicated by the obtained correction data. Then, the voltage correcting portion 14 stores the increased or decreased DC voltage level in the RAM.

In this way, the development control portion 12 outputs the control signal indicating the increased or decreased DC voltage level stored in the RAM by the voltage correcting portion 14 to the DC power supply portion 93. In this way, the voltage correcting portion 14 increases or decreases the DC voltage level in accordance with the variation indicated by the detection data output from the variation detection portion 13.

For instance, as illustrated in FIG. 5, it is supposed that the variation storage portion 15 stores the correction data. In addition, it is supposed that the detection data output from the variation detection portion 13 indicates the variation of "+10 μA". In this case, the voltage correcting portion 14 obtains the correction data of "DC−20 V" stored in the variation storage portion 15 in association with the variation of "+10 μA". Then, the voltage correcting portion 14 decreases the target level of the DC voltage obtained from the RAM by "20 V" indicated by the obtained correction data and stores the decreased DC voltage level in the RAM. When the detection data output from the variation detection portion 13 indicates the variation of "+20 μA", the voltage correcting portion 14 obtains the correction data of "DC−25 V" stored in the variation storage portion 15 in association with the variation of "+20 μA". Then, the voltage correcting portion 14 decreases the target level of the DC voltage obtained from the RAM by "25 V" and stores the decreased DC voltage level in the RAM.

In this way, the voltage correcting portion 14 decreases the DC voltage level to be applied to the developing roller 72 more as the current value detected by the current detecting portion 95 increases more, as indicated by the correction data stored in the variation storage portion 15.

On the other hand, it is supposed that the detection data indicates the variation of "−10 μA". In this case, the voltage correcting portion 14 obtains the correction data of "DC+20 V" stored in the variation storage portion 15 in association with the variation of "−10 μA". Then, the voltage correcting portion 14 increases the target level of the DC voltage obtained from the RAM by "20 V" indicated by the obtained correction data and stores the increased DC voltage level in the RAM. When the detection data indicates the variation of "−20 μA", the voltage correcting portion 14 obtains the correction data of "DC+25 V" stored in the variation storage portion 15 in association with the variation of "−20 μA". Then, the voltage correcting portion 14 increases the target level of the DC voltage obtained from the RAM by "25 V" and stores the increased DC voltage level in the RAM.

In this way, the voltage correcting portion 14 increases the DC voltage level to be applied to the developing roller 72 as the current value detected by the current detecting portion 95 decreases more, as indicated by the correction data stored in the variation storage portion 15.

In other words, it is considered that the load of the developing roller 72 is decreased more as the current value of the AC current input to the developing roller 72 increases more. Accordingly, the voltage correcting portion 14 decreases the DC voltage level to be applied to the developing roller 72 more as an increase amount of the current value is larger. On the contrary, it is considered that the load of the developing roller 72 is increased more as the current value of the AC current input to the developing roller 72 decreases more. Accordingly, the voltage correcting portion 14 increases the DC voltage level to be applied to the developing roller 72 more as a decrease amount of the current value is larger.

Note that the variation of the load of the developing roller 72 occurs due to a variation of the distance between the developing roller 72 and the photosensitive drum 37, for example. The variation of the distance occurs due to, for example, a variation of a layer thickness of toner on the developing roller 72 or an eccentricity of the developing roller 72 or the photosensitive drum 37. When the above-mentioned distance is decreased, a capacitance between the developing roller 72 and the photosensitive drum 37 increases, and hence the load of the developing roller 72 is increased. On the other hand, when the distance is increased, the capacitance between the developing roller 72 and the photosensitive drum 37 is decreased, and hence the load of the developing roller 72 is decreased.

The time setting portion 16 obtains the initial value of the set time stored in advance in the ROM or the like and stores the obtained initial value as the set time in the RAM. In this way, the time setting portion 16 sets initially the set time. Note that the initial value of the set time is determined to be a sufficiently longer time (for example, an hour) than the time necessary for the developing operation.

In addition, the time setting portion 16 measures the elapsed time from the first time point when the application of the AC voltage of the initial level is started. Then, the time setting portion 16 updates the set time stored in the RAM to the measured elapsed time when the current value detected by the current detecting portion 95 becomes a predetermined target current value. In this way, the time selling portion 16 sets again the set time. Note that the target current value is determined to be the current value of the AC current to be input to the developing roller 72 when the AC voltage of the target level is applied, on the basis of experimental values of a test operation or the like, and is stored in advance in the ROM or the like.

Figure 6B:
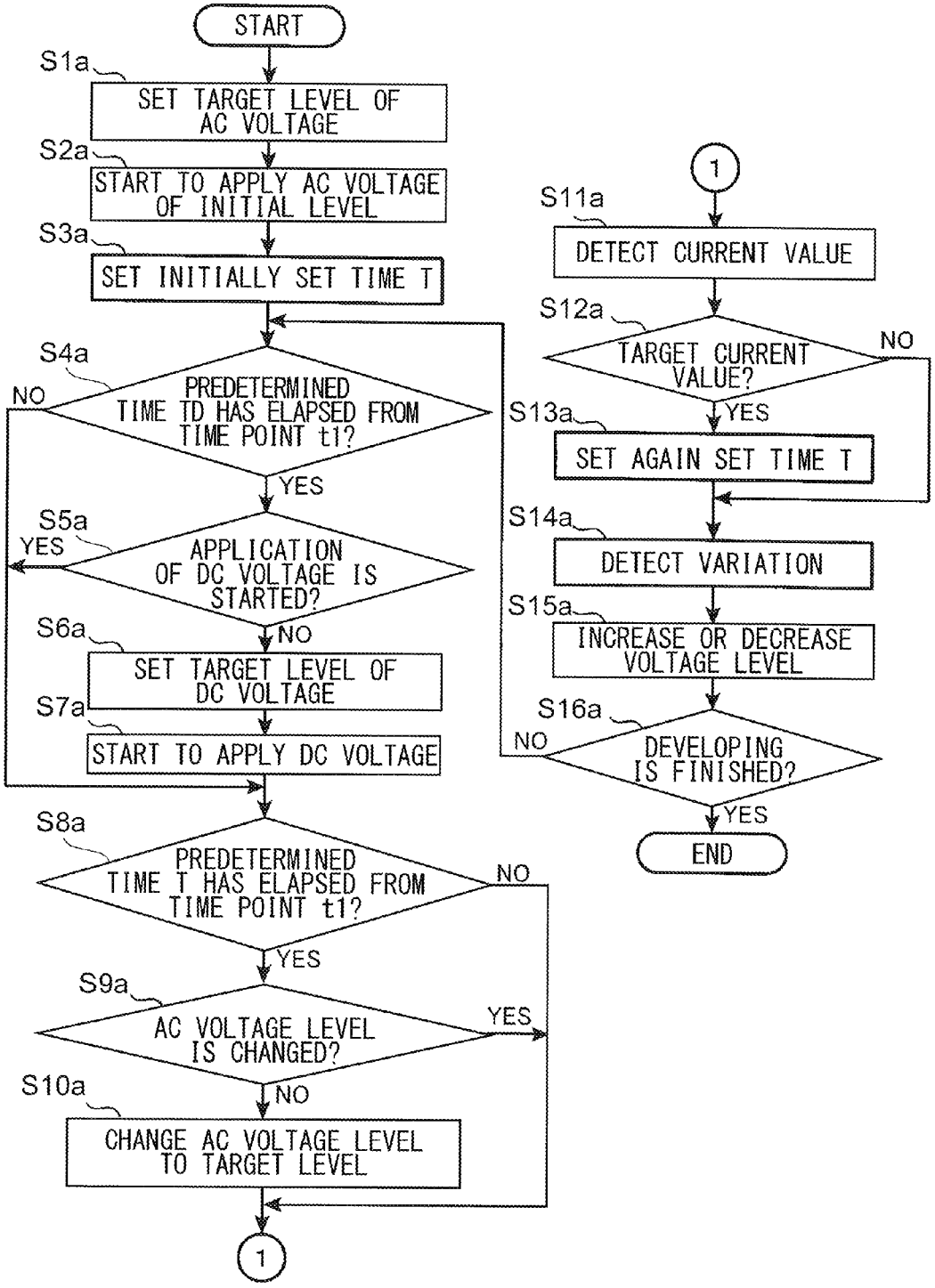
FIG. 6B is a flowchart illustrating an operation of applying the developing bias voltage of the second embodiment.

Hereinafter, the operation of applying the developing bias voltage is described. FIG. 6B is a flowchart illustrating the operation of applying the developing bias voltage.

It is supposed that when the control unit 10 receives a print job including the image data from the external computer or the like, the image forming unit 7 starts the image forming operation, and the developing operation is started in the process of the image forming operation. In this case, as illustrated in FIG. 6B, the initial voltage selling portion 11 obtains the target level of the AC voltage to be applied to the developing roller 72, which is stored in the ROM or the like, and stores the obtained target level of the AC voltage in the RAM. In this way, the initial voltage setting portion 11 sets the target level of the AC voltage (S1*a*).

Next, the development control portion 12 obtains the target level of the AC voltage stored in the RAM in Step S1*a*. Then, the development control portion 12 increases the obtained target level by the predetermined level stored in the ROM or the like, so as to determine the initial level of the AC voltage. Then, the development control portion 12 starts to output the control signal indicating the determined initial level to the AC power supply portion 94. In this way, the development control portion 12 controls the AC power supply portion 94 to start the application of the AC voltage of the initial level indicated by the control signal (S2*a*). After this, the development control portion 12 continues to output the control signal to the AC power supply portion 94.

The time setting portion 16 obtains the initial value of the set time stored in advance in the ROM or the like and stores the obtained initial value as the set time T in the RAM. In this way, the time setting portion 16 sets initially the set time T (S3*a*). In addition, the time setting portion 16 starts to measure the elapsed time from the time point t1 (first time point) when the application of the AC voltage of the initial level is started in Step S2*a*.

The development control portion 12 does not output the control signal indicating the DC voltage level to the DC power supply portion 93 when a predetermined time TD has not elapsed from the time point t1 (NO in S4*a*). In this case, Step S8*a* described later is performed in the state where the DC voltage is not applied to the developing roller 72 and only the AC voltage is applied to the developing roller 72. Note that the development control portion 12 uses the same time as the set time T stored in the RAM by the time selling portion 16 as the predetermined time TD in Step S3*a* or Step S13*a* described later.

On the other hand, when the predetermined time TD has elapsed from the time point t1 (YES in S4*a*) and the application of the DC voltage is not started (NO in S5*a*), the initial voltage setting portion 11 obtains the target level of the DC voltage to be applied to the developing roller 72, which is stored in the ROM or the like. The initial voltage setting portion 11 stores the obtained target level of the DC voltage in the RAM so as to set the target level of the DC voltage (S6*a*).

Then, the development control portion 12 starts to output the control signal indicating the target level of the DC voltage stored in the RAM to the DC power supply portion 93. In this way, the development control portion 12 controls the DC power supply portion 93 to start the application of the DC voltage of the target level indicated by the control signal at the second time point that is the predetermined time TD after the time point t1 (S7*a*). After this, the development control portion 12 continues to output the control signal to the DC power supply portion 93 until the developing operation is finished.

In addition, when the set time T set in the RAM has not elapsed from the time point t1 (NO in S8*a*), the development control portion 12 does not change the control signal indicating the initial level of the AC voltage that has been output from Step S2*a* and continues to output the control signal. In this case, Step S11 described later is performed in the state where the AC voltage that is gradually stabilized at the initial level is applied to the developing roller 72.

On the other hand, when the set time T set in the RAM has elapsed from the time point t1 (YES in S8*a*) and the AC voltage level is not changed (NO in S9*a*), the development control portion 12 changes the control signal to be output to the AC power supply portion 94 from the control signal indicating the initial level of the AC voltage that has been output from Step S2*a* to the control signal indicating the target level of the AC voltage stored in the RAM in Step S1*a* (S10*a*).

In this way, the development control portion 12 changes the AC voltage level to be applied to the AC power supply portion 94 to the target level of the AC voltage set in Step S1*a* at the third time point that is the set time T after the time point t1. After this, the development control portion 12 continues to output the control signal indicating the target level of the AC voltage until the developing operation is finished.

After the application of the AC voltage is started in Step S2*a*, the current detecting portion 95 detects the current value of the AC current input to the developing roller 72, regardless of whether or not the application of the DC voltage is started, and whether or not the AC voltage level is changed (S11*a*).

The time setting portion 16 updates the set time T stored in the RAM to the elapsed time from the time point t1, which has been measured since Step S3*a*, at the time point when the current value detected in Step S11*a* becomes the target current value stored in advance in the ROM or the like (YES in S12*a*). In this way, the time setting portion 16 sets again the set time T (S13*a*).

The variation detection portion 13 detects the variation of the current value by using the current value detected in Step S11*a* and the current value detected last time (having an initial value of zero) stored in the RAM, and outputs the detection data indicating the detected variation (S14*a*). Note that the variation detection portion 13 outputs the detection data in Step S14*a* and then stores in the RAM the current value detected in Step S11*a* as the current value detected last time.

Next, as described above, the voltage correcting portion 14 obtains the correction data stored in the variation storage portion 15 in association with the variation indicated by the detection data output in Step S14*a*, and increases or decreases the target level of the DC voltage obtained from the RAM by the amount indicated by the obtained correction data. Then, the voltage correcting portion 14 stores the increased or decreased DC voltage level in the RAM (S15*a*).

In this way, when the application of the DC voltage is started in Step S7*a*, the development control portion 12 outputs the control signal indicating the increased or decreased DC voltage level stored in the RAM to the DC power supply portion 93. As a result, the DC voltage of the increased or decreased DC voltage level is applied to the developing roller 72. On the other hand, when the application of the DC voltage is not started in Step S7*a*, the development control portion 12 does not output the control signal indicating the DC voltage level, and hence the increased or decreased DC voltage level is only stored in the RAM.

After Step S15*a* is performed, when the developing operation is not finished (NO in S16*a*), the process of Step S4*a* and the following steps is repeated.

Note that in Step S8*a* after performing Step S13*a*, the development control portion 12 uses the set time T stored (reset) in the RAM in Step S13*a*. In addition, in Step S4*a* after performing Step S13*a*, the development control portion 12 uses the same time as the set time T stored (reset) in the RAM in Step S13*a* as the predetermined time TD. In other words, the second time point when the application of the DC voltage is started in Step S7*a* is identical to the third time point when the AC voltage level is changed to the target level in Step S10*a*.

Figure 8A:
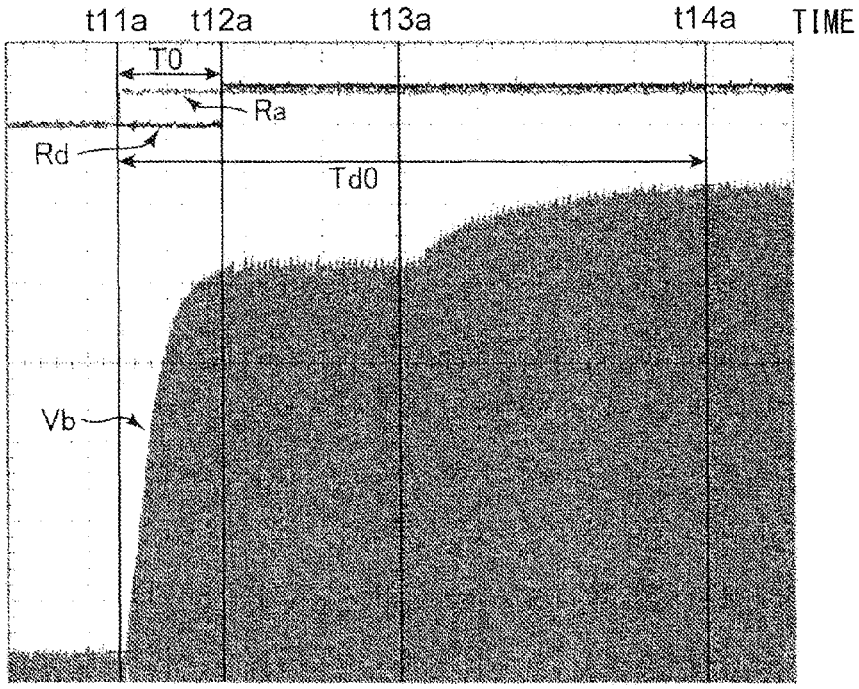
FIG. 8A is a schematic diagram illustrating an example of a waveform of the developing bias voltage when a target level of the AC voltage is not changed.
Figure 8B:
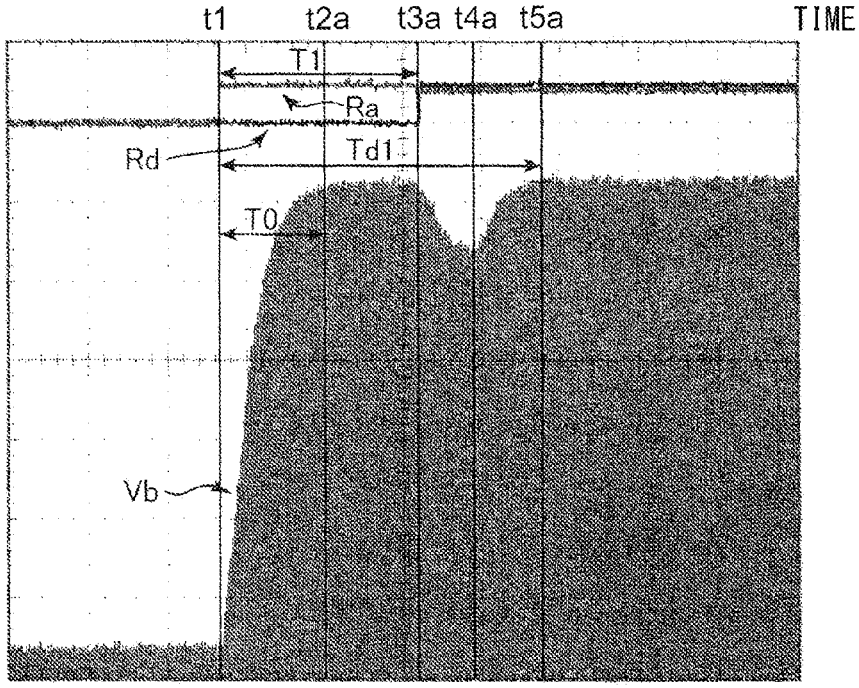
FIG. 8B is a schematic diagram illustrating an example of a waveform of the developing bias voltage when the target level of the AC voltage is changed.

Hereinafter, an example of a waveform of the developing bias voltage Vb in the developing operation of this embodiment is described. FIG. 8A is a schematic diagram illustrating an example of a waveform of the developing bias voltage Vb in the case where the target level of the AC voltage is not changed. FIG. 8B is a schematic diagram illustrating an example of a waveform of the developing bias voltage Vb in the case where the target level of the AC voltage is changed. Note that FIGS. 8A and 8B illustrate only the waveform of the positive (+) level as the waveform of the developing bias voltage Vb. In addition, a horizontal axis and a vertical axis have the same scale in FIGS. 8A and 8B.

In the conventional structure, output of the control signal Ra indicating the target level of the AC voltage is started at time point t11*a* as illustrated in FIG. 8A, for example. In this way, application of the AC voltage of the target level is started at the time point t11*a*. Then, when the AC voltage level reaches the target level at time point t12*a* when a time T0 has elapsed from the time point t11*a*, output of the control signal Rd indicating the target level of the DC voltage is started.

In this case, the current value of the AC current input to the developing roller 72 is largely increased also after the time point t12*a* due to a rapid increase of the AC voltage level until the time point t12*a*. For this reason, although the application of the DC voltage is started at the time point t12*a*, the voltage correcting portion 14 decreases the DC voltage level to a level lower than zero so that the DC voltage is not output after the time point t12*a*.

After that, when the AC voltage level is stabilized at the target level at time point t13*a*, the increase amount of the AC current is also gradually decreased. Accordingly, after the time point t13*a*, a decrease amount of the DC voltage level by the voltage correcting portion 14 is gradually decreased, and the DC voltage level is gradually increased to the target level of the DC voltage.

After that, when the current value of the AC current is stabilized at the target current value at time point t14*a*, the voltage correcting portion 14 does not increase or decrease the DC voltage level, and hence the DC voltage level is stabilized at the target level.

In this way, in the conventional structure, the current value of the AC current continues to increase after the time point t11*a* when the application of the AC voltage is started and is stabilized at the target current value at the time point t14*a*. Accordingly, in the conventional structure, the voltage correcting portion 14 performs the correction of decreasing the DC voltage level during the period from the time point t12*a* when the application of the DC voltage is started to the time point t14*a*.

In contrast to this, in the structure of the embodiment described above, as illustrated in FIG. 8B, for example, Step S2*a* (FIG. 6B) is performed at the time point t1. In other words, in the time point t1, the development control portion 12 starts the output of the control signal Ra indicating the initial level higher than the target level of the AC voltage. In this way, the development control portion 12 starts the application of the AC voltage having the initial level at the time point t1.

In this case, the AC voltage level is rapidly increased from the start of the application of the AC voltage of the target level illustrated in FIG. 8A. In association with this, the current value of the AC current is also rapidly increased.

In this way, the AC voltage level reaches the initial level higher than the target level at time point t2*a* when the time T0 illustrated in FIG. 8A has elapsed from the time point t1. In addition, at time point t3*a* when a time T1 shorter than the time Td0 illustrated in FIG. 8A has elapsed from the time point t1, the current value of the AC current reaches the target current value. Then, the time setting portion 16 stores in the RAM the elapsed time T1 from the time point t1 to the time point t3*a* as the set time T in Step S13*a* (FIG. 6B).

As a result, the development control portion 12 performs the Step S7*a* (FIG. 6B) at the time point t3*a* when the predetermined time TD that is identical to the set time T has elapsed from the time point t1. In other words, at the time point t3*a*, the development control portion 12 starts to output the control signal Rd indicating the target level of the DC voltage. In addition, the development control portion 12 performs Step S10*a* (FIG. 6B) at the time point t3*a* when the set time T has elapsed from the time point t1. In other words, at the time point t3*a*, the development control portion 12 changes the control signal to be output to the AC power supply portion 94 to the control signal Ra indicating the target level lower than the initial level of the AC voltage.

After the time point t3*a*, the AC voltage level is gradually stabilized at the target level indicated by the control signal Ra that is changed at the time point t3*a*. On the other hand, the current value of the AC current is largely increased also after the time point t3*a* due to the rapid increase of the AC voltage level until the time point t2*a*. Accordingly, although the application of the DC voltage is started at the time point t3*a*, the voltage correcting portion 14 decreases the DC voltage level to a level below zero so that the DC voltage is not output in Step S15*a* (FIG. 6B) after the time point t3*a*. In other words, after the time point t3*a*, the AC voltage level is gradually decreased in the state where the DC voltage is not output.

After that, when the AC voltage level is stabilized at the target level at time point t4*a*, the current value of the AC current that has increased from the target current value after the time point t3*a* is decreased to close to the target current value again. Accordingly, after the time point t4*a*, in Step S15*a* (FIG. 6B), the voltage correcting portion 14 increases the DC voltage level to a target level or higher so that the DC voltage level is rapidly increased.

After that, when the current value of the AC current is stabilized at the target current value at time point t5*a*, the voltage correcting portion 14 does not increase or decrease the DC voltage level so that the DC voltage level is also stabilized at the target level. In other words, in the structure of this embodiment, at the time point (time point t5*a*) when the time Td1 that is shorter than the time Td0 has elapsed from the time point t1, the developing bias voltage Vb in which the DC voltage of the target level and the AC voltage of the target level are added is applied to the developing roller 72.

In this way, in the structure of the embodiment described above, the current value of the AC current is increased after the time point t1 when the application of the AC voltage is started, and once reaches the target current value at the time point t3*a*. Then, the current value of the AC current increases also after the time point t3*a*, but decreases from the time point t4*a* when the AC voltage level is stabilized at the target level, and is stabilized at the target current value at the time point t5*a*. Accordingly, in the structure of the embodiment described above, the voltage correcting portion 14 performs the correction of decreasing the DC voltage level during the period from the time point t3*a* when the application of the DC voltage is started to the time point t4*a*, which is shorter than the period from the time point t12*a* to the time point t14*a* illustrated in FIG. 8A.

In this way, according to the structure of the embodiment described above, the application of the AC voltage of the initial level higher than the target level is started at the time point t1 (first time point), and the AC voltage level is changed to the target level at the time point t3*a* (third time point) when the set time T has elapsed from the time point t1. Accordingly, as illustrated in FIG. 8A, it is possible to increase the AC voltage level more rapidly than the case where the AC voltage of the target level is applied from start of the application of the AC voltage (hereinafter referred to as Case B). In this way, it is possible to stabilize the AC voltage level at the target level more quickly than in Case B.

In addition, when the AC voltage level is increased more rapidly than in Case B, it is possible to increase the current value of the AC current input to the developing roller 72 more rapidly than in Case B. In this way, the time necessary for the current value of the AC current to be stabilized at the target current value can be shorter than in Case B. As a result, the period for the voltage correcting portion 14 to decrease the DC voltage level in accordance with an increase of the current value of the AC current can be shorter than in Case B. In this way, the DC voltage level can be stabilized at the target level more quickly than in Case B.

In addition, the current value of the AC current becomes the target current value at the time point t3*a*. Thus, the current value of the AC current can be stabilized at the target current value in a short period after changing the AC voltage level to the target level at the time point t3*a*. In this way, the period for the voltage correcting portion 14 to decrease the DC voltage level in accordance with an increase of the current value of the AC current after the time point t3*a* can be shortened.

In addition, a time point that is after the time point t1 and before the time point t3*a* (hereinafter referred to as time point B) is closer to the start time point of the application of the AC voltage than the time point t3*a*. Accordingly, a possibility that the current value of the AC current is rapidly increased is higher at the time point B than at the time point t3*a*. Thus, when the application of the DC voltage is started at the time point B, the period while the voltage correcting portion 14 decreases the DC voltage level largely becomes longer than in the case where the application of the DC voltage is started at the time point t3*a* so that the DC power supply portion 93 is operated wastefully.

However, according to this structure, the application of the DC voltage is started at the time point t3*a*, and therefore the period for the voltage correcting portion 14 to largely decrease the DC voltage level can be shorter than in the case where the application of the DC voltage is started at the time point B. In this way, the DC power supply portion 93 can be operated efficiently.

Note that the second embodiment is merely an example of the embodiment of the present disclosure, and the present disclosure is not limited to the embodiment. For instance, the following modified embodiments may be adopted.

(1) The control unit 10 may be constituted of a control circuit such as an ASIC that can perform the same control as described above instead of the structure in which the control program is executed for controlling operations of the individual portions as described above in the embodiment.

(2) It is possible to configure that the control unit 10 does not work as the time setting portion 16, so as to eliminate Step S12*a* (FIG. 6B) and Step S13*a* (FIG. 6B). In association with this, it is possible to measure the elapsed time from the time point when the application of the AC voltage of the initial level to the developing roller 72 is started until the current value detected by the current detecting portion 95 becomes the target current value with an experiment of a test operation or the like, and to store the measured elapsed time as the set time T in the ROM or the like in advance. Then, the development control portion 12 may use the set time T stored in advance in the ROM or the like, in Step S8*a* (FIG. 6B).

(3) The development control portion 12 controls the DC power supply portion 93 to start the application of the DC voltage of the target level indicated by the control signal at the second time point when the predetermined time TD has elapsed from the time point t1 in Step S7*a* (FIG. 6B). This predetermined time TD is not limited to the same time as the set time T but may be a time of zero or longer, which is different from the set time T. In other words, the development control portion 12 may start the application of the DC voltage of the target level at a time point after the time point t1, which is different from the time point t3*a* when the set time T has elapsed from the time point t1.

For instance, the predetermined time TD may be set to be longer than the set time T. In this case, the application of the DC voltage is started after the time point t3*a*, and therefore the period for the voltage correcting portion 14 to largely decrease the DC voltage level can be shorter than in the case where the application of the DC voltage is started at the time point B. In this way, the DC power supply portion 93 can be efficiently operated.

As described above, the method for applying a voltage with the power supply unit 9 according to this embodiment includes: controlling the AC power supply portion 94 to start application of an AC voltage having a higher level than a predetermined AC target level at a first time point, when applying a voltage to the developing roller 72 (developer carrier); controlling the DC power supply portion 93 to start application of a DC voltage having a predetermined DC target level at a second time point after the first time point; and changing the AC voltage level to be applied by the AC power supply portion 94 to the AC target level at a third time point that is a predetermined set time after the first time point.

In this way, it is possible to prevent the time until both the DC voltage and the AC voltage are stabilized at initial levels from being long, so that the AC voltage level and the DC voltage level can be quickly stabilized at the target levels.

In other words, according to this second embodiment, it is possible to provide the power supply unit, the image forming apparatus and the method for applying a voltage, in which the DC voltage applied to the developer carrier can be quickly stabilized at the target level.

What is claimed is:

1. A power supply unit for applying a voltage to a developer carrier that carries developer, comprising:

a DC power supply portion that applies a DC voltage that is gradually stabilized at a predetermined DC target level to the developer carrier;

an AC power supply portion that applies an AC voltage that is gradually stabilized at a predetermined AC target level to the developer carrier;

a current detecting portion that detects current input to the developer carrier;

a voltage correcting portion that decreases at least one of voltage levels of the DC voltage and the AC voltage more as the current detected by the current detecting portion becomes larger; and a development control portion that controls to start application of the AC voltage as a first voltage at a first time point, and to start application of the DC voltage as a second voltage at a second time point that is a predetermined time after the first time point, wherein a current value detected by the current detecting portion is an AC current value, the voltage correcting portion decreases the DC voltage level more as the current value detected by the current detecting portion becomes larger, and the development control portion controls the AC power supply portion to start application of the AC voltage having a higher level than the predetermined AC target level at the first time point, to control the DC power supply portion to start application of the DC voltage having the predetermined DC target level at the second time point after the first time point, and to change the AC voltage level applied by the AC power supply portion to the AC target level at a third time point that is a predetermined set time after the first time point.

2. The power supply unit according to claim 1, wherein a target current value of AC current to be input to the developer carrier when the AC voltage having the AC target level is applied is determined in advance, and the set time is determined in advance to be an elapsed time from start of the application of the AC voltage having the high level without applying the DC voltage until a time point when a current value of the AC current becomes the target current value.

3. The power supply unit according to claim 1, wherein a target current value of AC current to be input to the developer carrier when the AC voltage having the AC target level is applied is determined in advance, and the power supply unit further includes a time setting portion that measures an elapsed time from the first time point until a time point when the current value detected by the current detecting portion becomes the target current value, so as to set the measured elapsed time as the set time.

4. The power supply unit according to claim 1, wherein the second time point is after the third time point.

5. An image forming apparatus comprising the power supply unit according to claim 1; and an image forming portion, wherein the image forming portion includes the developer carrier, an image carrier for carrying a latent image disposed at a position opposed to the developer carrier, and a secondary transfer roller for transferring a developed image on the image carrier onto a paper sheet, so as to transfer the developed image on the image carrier onto the paper sheet when the power supply unit applies the DC voltage and the AC voltage to the developer carrier so that the developer is supplied to the latent image.

6. A method for applying the voltage with the power supply unit according to claim 1, the method comprising: via the development control portion, starting the application of the AC voltage having the higher level than the predetermined AC target level at the first time point so as to shorten a period necessary for the current value of the AC current to reach the target current value;

starting the application of the DC voltage having the predetermined DC target level at the second time point after the first time point; and starting the application of the AC voltage having the predetermined AC target level at the third time point so as to quickly stabilize the levels of the AC and DC voltages at the AC and DC target levels respectively.

* * * * *